US011534642B2

(12) United States Patent
Worsman et al.

(10) Patent No.: US 11,534,642 B2
(45) Date of Patent: Dec. 27, 2022

(54) FIRE EXTINGUISHING SYSTEMS AND COMPOSITIONS AND METHODS OF USE THEREOF

(71) Applicant: Extreme Fire Solutions, LLC, Garden Grove, CA (US)

(72) Inventors: Chrystel Worsman, Garden Grove, CA (US); Zachary Albert Cornwell, Foothill Ranch, CA (US)

( * ) Notice: Subject to any disclaimer, the term of this patent is extended or adjusted under 35 U.S.C. 154(b) by 439 days.

(21) Appl. No.: 16/694,781

(22) Filed: Nov. 25, 2019

(65) Prior Publication Data

US 2020/0094093 A1 Mar. 26, 2020

Related U.S. Application Data

(63) Continuation of application No. PCT/US2018/035443, filed on May 31, 2018.

(60) Provisional application No. 62/582,689, filed on Nov. 7, 2017, provisional application No. 62/514,426, filed on Jun. 2, 2017.

(51) Int. Cl.
*A62D 1/00* (2006.01)
*A62D 1/02* (2006.01)

(52) U.S. Cl.
CPC ..... *A62D 1/0014* (2013.01); *A62D 1/0064* (2013.01); *A62D 1/005* (2013.01); *A62D 1/0042* (2013.01); *A62D 1/0071* (2013.01); *A62D 1/0092* (2013.01)

(58) Field of Classification Search
CPC ..... A62D 1/0042
See application file for complete search history.

(56) References Cited

U.S. PATENT DOCUMENTS

| | | | |
|---|---|---|---|
| 4,278,552 | A | 7/1981 | Hisamoto et al. |
| 4,851,224 | A | 7/1989 | McAnalley |
| 5,085,786 | A | 2/1992 | Alm et al. |
| 5,425,885 | A | 6/1995 | Zhao |
| 5,686,024 | A | 11/1997 | Dahanayake et al. |
| 5,804,203 | A | 9/1998 | Hahn et al. |
| 6,518,345 | B2 | 2/2003 | Tanaka et al. |
| 6,706,923 | B2 | 3/2004 | Haniff et al. |
| 8,034,740 | B2 | 10/2011 | Kitahata et al. |
| 8,257,607 | B1 | 9/2012 | Johnson et al. |
| 8,551,509 | B2 | 10/2013 | Aoki et al. |
| 8,632,838 | B2 | 1/2014 | Roth et al. |
| 8,852,648 | B2 | 10/2014 | Salamone et al. |
| 8,916,058 | B2 | 12/2014 | Severac et al. |
| 8,951,508 | B2 | 2/2015 | Schlifke-Poschalko |
| 9,023,399 | B2 | 5/2015 | Filippova et al. |
| 9,095,522 | B2 | 8/2015 | Grune |
| 9,173,972 | B2 | 11/2015 | Wooley et al. |
| 9,314,482 | B2 | 4/2016 | Wooley et al. |
| 2003/0010507 | A1 | 1/2003 | Greiner et al. |
| 2004/0010066 | A1 | 1/2004 | Devine |
| 2008/0031907 | A1 | 2/2008 | Tamarkin et al. |
| 2008/0317798 | A1 | 12/2008 | Benjamin et al. |
| 2009/0257968 | A1 | 10/2009 | Walton et al. |
| 2010/0181084 | A1 | 7/2010 | Carmo |
| 2012/0292551 | A1 | 11/2012 | Klaffmo |
| 2013/0195925 | A1* | 8/2013 | Arshed ..... A23L 33/175 424/62 |
| 2013/0221263 | A1 | 8/2013 | Prat et al. |
| 2013/0295218 | A1 | 11/2013 | Hinton et al. |
| 2013/0313465 | A1 | 11/2013 | Podella et al. |
| 2014/0284511 | A1 | 9/2014 | Klaffmo et al. |
| 2015/0251034 | A1 | 9/2015 | Vellmar |
| 2015/0342854 | A1* | 12/2015 | Shibuya ..... A61P 35/00 424/769 |
| 2016/0030792 | A1 | 2/2016 | Shalev et al. |
| 2016/0038778 | A1 | 2/2016 | Siem |
| 2016/0096192 | A1 | 4/2016 | Bush et al. |

FOREIGN PATENT DOCUMENTS

| | | |
|---|---|---|
| CA | 2701378 | 10/2011 |
| EP | 1153553 | 11/2001 |
| JP | 2006-061249 A | 3/2006 |
| WO | WO 2014/025929 A9 | 2/2014 |
| WO | WO 2018/222902 A1 | 12/2018 |

OTHER PUBLICATIONS

Aloe Vera Tea, About Aloe Tea, May 17, 2017 [Retrieved on Jul. 27, 2018], Retrieved from the internet: URL:https://web.archive.org/web/20170517152948/http://www.aloe-tea.com/aboutaloetea.php entire document.

International Search Report and Written Opinion in PCT/US2018/035443 dated Aug. 29, 2018.

* cited by examiner

*Primary Examiner* — Peter F Godenschwager
(74) *Attorney, Agent, or Firm* — Obi Iloputaife, Esq.

(57) ABSTRACT

Some embodiments disclosed herein pertain to compositions for extinguishing or suppressing fires, systems for using the same, methods of making compositions for extinguishing or suppressing fires, and/or methods of using the same. In some embodiments, the compositions disclosed herein are suitable for use on Class D fires (e.g., suppressing or extinguishing the fires). In some embodiments, the compositions disclosed herein comprise a botanical material. In some embodiments, the compositions lack sugar alcohols and/or halogenated compounds.

9 Claims, 6 Drawing Sheets

Table 4.

| Product Name | Class A | Class B | Class C | Class D | Class K | Health | Reactivity | Flammability | Mix Reaction | MSDS | Exposure to 3623°F | Aquatic Life |
|---|---|---|---|---|---|---|---|---|---|---|---|---|
| EFS 3-6-10% | Yes | Yes | Yes | Yes | Yes | 0 | 0 | 0 | N/A | 0-0-0 | Boils | Yes |
| Commercial Formulation 1 | Yes | No | No | No | No | 1 | 0 | 1 | Not Compatible | 1-0-0 | Ignition | No |
| Commercial Formulation 2 | Yes | Yes | No | No | No | 1 | 0 | 0 | None | 1-0-0 | Boils/Burns Away | No |
| Commercial Formulation 3 | Yes | Yes | No | No | No | 1 | 0 | 0 | None | 1-0-0 | Boils/Burns Away | No |
| Commercial Formulation 4 | Yes | Yes | No | No | No | 1 | 0 | 1 | None | | Boils/Burns Away | No |
| Commercial Formulation 5 | Yes | Yes | No | No | No | 1 | 0 | 0 | None | 1-0-0 | Boils/Burns Away | No |
| Commercial Formulation 6 | Yes | Yes | No | No | No | 1 | 0 | 1 | Not Compatible | 1-0-0 | Boils | No |
| Commercial Formulation 7 | Yes | Yes | No | No | No | 1 | 0 | 0 | None | 0-0-0? | Boils/Burns Away | Yes |
| Commercial Formulation 8 | Yes | Yes | No | No | No | 1 | 0 | 0 | None | 1-0-0 | Boils | Yes |
| Commercial Formulation 9 | Yes | Yes | No | No | No | 2 | 0 | 0 | None | 2-0-0 | Boils | No |
| Commercial Formulation 10 | Yes | Yes | No | No | No | 2 | 0 | 0 | None | 2-0-0 | Boils/Burns Away | No |
| Commercial Formulation 11 | Yes | No | No | No | No | 2 | 0 | 0 | None | 2-0-0 | Boils/Burns Away | No |
| Commercial Formulation 12 | Yes | No | No | No | No | 1 | 0 | 0 | None | 1-0-0 | Boils/Burns Away | No |
| Commercial Formulation 13 | Yes | Yes | No | No | No | 0 | 0 | 0 | None | 0-0-0 | Boils/Burns Away | No |

Fig. 1

FIRE EXTINGUISHING SYSTEMS AND COMPOSITIONS AND METHODS OF USE THEREOF

CROSS-REFERENCE TO RELATED APPLICATIONS

This application is a continuation of International PCT Application No. PCT/US2018/035443 filed May 31, 2018, which claims priority to U.S. Provisional Application No. 62/582,689, filed Nov. 7, 2017, and U.S. Provisional Application No. 62/514,426, filed Jun. 2, 2017. All of the foregoing applications are hereby incorporated by reference in their entireties.

BACKGROUND

Field

This disclosure relates generally to the field of compositions for extinguishing fires, systems employing those compositions, and their methods of manufacture and use.

Description of the Related Art

Fire extinguishing compositions are commonly employed to put out fires (e.g., extinguish them) and/or suppress the spread of fires (slow or stop their progress). Different combustible materials often are extinguished using different fire extinguishing compositions. The type of combustible material that is burning in a fire determines the classification of the fire. In the United States, the classifications of fire include Class A (e.g., combustible materials, such as, wood, paper, fabric, refuse, etc.), Class B (e.g., flammable liquids and gases), Class C (e.g., electrical fires), Class D (e.g., metal fires), and Class K (e.g., cooking oils and fats).

SUMMARY

Disclosed herein are fire extinguishing (or fire suppressing) compositions that extinguish various classes of fires. In some embodiments, the fire extinguishing composition is a concentrate. In some embodiments, the composition comprises a botanical material. In some embodiments, the composition comprises a thickening agent. In some embodiments, the composition comprises water. In some embodiments, the composition is halogen-free. In some embodiments, the composition is free of sugar alcohols. In some embodiments, the composition is configured to extinguish or suppress Class D fires. In some embodiments, the composition is configured to extinguish or suppress magnesium fires. In some embodiments, the botanical material is an aloe vera extract. In some embodiments, the thickening agent comprises a saccharide material and/or a cellulosic material. In some embodiments, the thickening agent is selected from the group consisting of methylcellulose, sodium carboxymethylcellulose (SCMC), and gellan gum. In some embodiments, the composition further comprises a surfactant. In some embodiments, the composition further comprises a humectant. In some embodiments, the composition further comprises a pH adjusting agent. In some embodiments, the composition further comprises a preservative. In some embodiments, the composition comprises 1,3-propane diol.

Some embodiments pertain to a fire extinguishing or suppressing composition comprising a botanical material. In some embodiments, the composition comprises water. In some embodiments, the composition is halogen-free. In some embodiments, the composition is free of sugar alcohols.

Any of the embodiments described above, or described elsewhere herein, can include or exclude one or more of the following features.

In some embodiments, the botanical material comprises an extract from the organic inner leaf aloe vera, aloe vera extract, acemannan, or combinations thereof. In some embodiments, the organic inner leaf aloe vera, aloe vera extract, acemannan, or combinations thereof is a powdered extract that can be mixed with water to provide the botanical material. In some embodiments, the botanical material is an aloe vera extract.

In some embodiments, the composition further comprises a thickening agent. In some embodiments, the thickening agent comprises a saccharide material. In some embodiments, the saccharide material comprises one or more polysaccharides. In some embodiments, the thickening agent comprises one or more of guar gum, carbomer, and/or xanthan gum. In some embodiments, the thickening agent comprises a cellulosic material. In some embodiments, the thickening agent is selected from the group consisting of methylcellulose, sodium carboxymethylcellulose, and gellan gum.

In some embodiments, the botanical material and the thickening agent are mutually miscible in water at a botanical material concentration of at least about 0.25% and a thickening agent concentration of at least about 0.3%.

In some embodiments, the composition further comprises a surfactant. In some embodiments, the surfactant is cocobetaine.

In some embodiments, the composition further comprises a preservative. In some embodiments, the preservative is phenoxyethanol.

In some embodiments, the composition further comprises a humectant. In some embodiments, the composition further comprises 1,3-propane diol.

In some embodiments, the composition further comprises a pH adjusting agent.

In some embodiments, the composition is configured to have a heat capacity of at least about 8.

In some embodiments, the composition is configured to extinguish Class D fires. In some embodiments, the composition is configured to extinguish magnesium fires.

Some embodiments pertain to a fire extinguishing composition comprising an acemannan polymer. In some embodiments, the composition comprises water. In some embodiments, the composition is halogen-free. In some embodiments, the composition is free of sugar alcohols.

In some embodiments, the composition is configured to extinguish magnesium fires. In some embodiments, the composition further comprises a thickening agent. In some embodiments, the composition further comprises a humectant. In some embodiments, the composition comprises 1,3-propane diol.

In some embodiments, the composition further comprises a pH adjusting agent. In some embodiments, the pH adjusting agent is present in a range from about 0.01% to about 3% by weight of the composition. In some embodiments, the pH adjusting agent comprises triethanolamine (TEA).

In some embodiments, the composition is configured to have a heat capacity of at least about 8. In some embodiments, the composition is configured to extinguish Class D fires.

Some embodiments pertain to a fire suppressing (and/or extinguishing) gel. In some embodiments, the gel comprises a botanical material. In some embodiments, the gel is halogen-free. In some embodiments, the gel is free of sugar alcohols. In some embodiments, the gel is also free of and/or lacks a surfactant. In some embodiments, the gel also is free of and/or lacks cocobetaine.

Some embodiments pertain to a composition concentrate comprising a botanical material. In some embodiments, the composition comprises a thickening agent. In some embodiments, the composition comprises water. In some embodiments, the composition is halogen-free. In some embodiments, the composition is free of sugar alcohols.

Some embodiments pertain to a fire extinguishing and/or fire suppressing composition concentrate comprising aloe vera powder. In some embodiments, the aloe vera powder has been reconstituted in water. Some embodiments pertain to a fire extinguishing and/or fire suppressing composition concentrate comprising aloe vera extract. In some embodiments, the composition comprises water. In some embodiments, the composition comprises a thickening agent is selected from the group consisting of guar gum, carbomer, xanthan gum, gum arabic, pectin, acacia gum, hydroxyl propyl guar, sodium carboxymethylcellulose, and combinations thereof. In some embodiments, the composition comprises cocobetaine. In some embodiments, the composition comprises 1,3-propanediol. In some embodiments, the composition comprises triethanolamine. In some embodiments, the composition has a pH of about 6.5 and about 7.0. In some embodiments, the fire extinguishing composition is free of sugar alcohols. In some embodiments, the composition further comprises a preservative.

In some embodiments, the fire extinguishing composition comprises aloe vera or an aloe vera extract (e.g., a concentrated extract from an aloe vera plant). In some embodiments, the fire extinguishing composition is halogen-free. In some embodiments, the fire extinguishing composition is free of sugar alcohols. In some embodiments, the fire extinguishing composition consists of aloe vera (and/or aloe vera extract) and water.

In some embodiments, the fire extinguishing composition is at least 50% aloe vera (or aloe vera-based product) by weight. In some embodiments, the aloe vera is present in a range from about 50% to about 95% by weight of the composition.

In some embodiments, the fire extinguishing composition further comprises a thickening agent. In some embodiments, the thickening agent is present in a range from about 0.1% to about 5.0% by weight of the composition. In some embodiments, the thickening agent comprises one or more of guar gum, carbomer, and/or xanthan gum.

In some embodiments, the fire extinguishing composition further comprises a surfactant. In some embodiments, the surfactant is present in a range from about 5% to about 20% by weight of the composition. In some embodiments, the surfactant comprises one or more of cocobetaine and/or decyl glycoside sodium.

In some embodiments, the fire extinguishing composition further comprises a humectant. In some embodiments, the humectant is present in a range from about 1% to about 30% by weight of the composition. In some embodiments, the humectant comprises 1,3-propane diol.

In some embodiments, the fire extinguishing composition further comprises a pH adjusting agent. In some embodiments, the pH adjusting agent is present in a range from about 0.01% to about 3% by weight of the composition. In some embodiments, the pH adjusting agent comprises triethylamine, triethanolamine, or both.

In some embodiments, the composition has a heat capacity of at least about 8.

In some embodiments, the composition is configured to extinguish a magnesium fire. In some embodiments, the composition extinguishes Class D fires.

Some embodiments pertain to a fire extinguishing composition comprising acemannan and xanthan gum. In some embodiments, the fire extinguishing composition is halogen-free. In some embodiments, the fire extinguishing composition is free of sugar alcohols.

As stated above, any of the embodiments described above, or described elsewhere herein, can include or exclude one or more of the following features.

In some embodiments, the composition further comprises a surfactant.

In some embodiments, the composition further comprises a humectant.

In some embodiments, the composition further comprises a pH adjusting agent.

In some embodiments, the composition is at least 50% aloe vera by weight.

In some embodiments, the aloe vera is present in a range from about 50% to about 95% by weight of the composition.

In some embodiments, the thickening agent is present in a range from about 0.1% to about 5.0% by weight of the composition.

In some embodiments, the thickening agent comprises one or more of guar gum, carbomer, and/or xanthan gum.

In some embodiments, the surfactant is present in a range from about 5% to about 40% by weight of the composition.

In some embodiments, the surfactant comprises one or more of cocobetaine and/or decyl glycoside sodium.

In some embodiments, the humectant is present in a range from about 1% to about 30% by weight of the composition.

In some embodiments, the humectant comprises 1,3-propane diol.

In some embodiments, the pH adjusting agent is present in a range from about 0.1% to about 3% by weight of the composition.

In some embodiments, the pH adjusting agent comprises triethanolamine.

In some embodiments, the composition has a heat capacity of at least about 8.

In some embodiments, the composition is configured to extinguish a magnesium fire.

In some embodiments, the composition extinguishes Class D fires.

In some embodiments, as described elsewhere herein, the composition is prepared as a concentrate and is diluted with water to provide a diluted formulation. In some embodiments, the concentrate or diluted formulation can be used in any of the applications disclosed herein. Some embodiments pertain to a dilute fire extinguishing composition comprising any features of any of the embodiments described above, or described elsewhere herein, and/or excluding one or more of those features. In some embodiments, the dilute composition contains the concentrate at a 10% by volume dilution with water. In some embodiments, the dilute composition contains the concentrate at a 3% by volume dilution with water.

Some embodiments pertain to a method for manufacturing a composition comprising any features of any of the embodiments described above, or described elsewhere herein, and/or excluding one or more of those features. In some embodiments, the method includes providing one or more of the ingredients of any of the embodiments described above. In some embodiments, the method includes mixing or combining any one or more of the ingredients of any of the embodiments described above. For instance, in some embodiments, a botanical material is provided. In some embodiments, the botanical material is mixed with the water.

Some embodiments pertain to a fire extinguishing (and/or suppressing) system. In some embodiments, the system comprises a composition comprising any features of any of the embodiments described above, or described elsewhere herein, and/or excluding one or more of those features. In some embodiments, the system comprises a vessel for dispersing the composition. In some embodiments, the vessel comprises a fire extinguisher canister. In some embodiments, the vessel comprises a fire hose with a proportioner that disperses the composition into water flowing through the hose.

Compositions for extinguishing or suppressing fires, systems for using the same, methods of making compositions for extinguishing or suppressing fires, and/or methods of using the same are disclosed. The compositions can comprise a botanical material such as aloe vera or extracts thereof and one or more additional chemical components/agents. The additional chemical components can include a thickening agent such as propanediol (e.g., 1,3-propanediol), a surfactant such as cocamidopropyl betaine, polysaccharides such as xanthan gum, guar gum or derivatives thereof, a pH adjusting agent such as triethanolamine, sodium gluconate, foaming agents, foam stabilizers, emulsifying agents, chelating agents, emollients, preservatives, bamboo extract, algae extracts, *Santalum acuminatum, Citrus glauca*, wattle seed extract, cactus extract, psicose, and water.

BRIEF DESCRIPTION OF THE DRAWINGS

FIG. 1 is a table showing comparison data for the testing of a disclosed embodiment versus commercially available fire extinguishing formulations.

FIG. 2A shows extinguished magnesium metal after extinguishing with a disclosed embodiment. FIG. 2B shows extinguished magnesium metal after extinguishing with a first commercial product. FIG. 2C shows extinguished magnesium metal after extinguishing with a first commercial product.

FIG. 3A shows the diesel fuel after ignition. FIG. 3B shows the application of a disclosed extinguishing composition to the fire. FIG. 3C shows the test result where the fire has been extinguished.

FIG. 4A shows the ignition of magnesium metal. FIG. 4B shows the application of a disclosed extinguishing composition to the burning metal. FIG. 4C shows the extinguished metal being handled with bare hands after extinguishing.

DETAILED DESCRIPTION

Figure 2C:
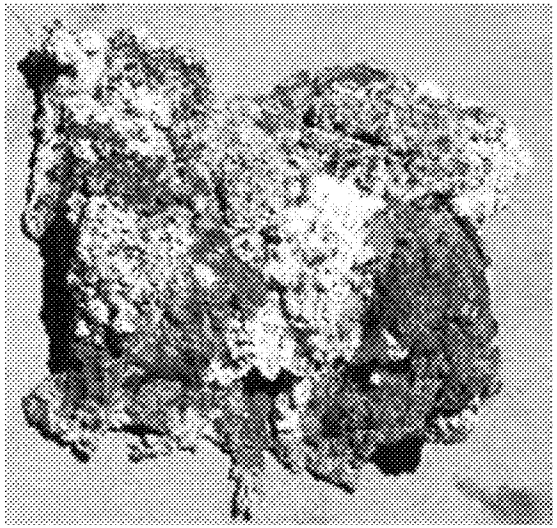
FIGS. 2A-C show magnesium metal after treatment with various extinguishing agents.

Some embodiments disclosed herein pertain to compositions for extinguishing or suppressing fires, systems for using the same, methods of making compositions for extinguishing or suppressing fires, and/or methods of using the same. In some embodiments, the compositions disclosed herein are suitable for use on Class D fires (e.g., suppressing or extinguishing the fires). In some embodiments, the fire extinguishing composition comprises a botanical composition. In some embodiments, the botanical composition comprises aloe vera or an aloe vera extract (e.g., a concentrated extract from an aloe vera plant, including an aloe vera powder). In some embodiments, the botanical composition comprises one or more polysaccharides. In some embodiments, the botanical composition comprises acemannan. In some embodiments, the fire extinguishing composition is halogen-free. In some embodiments, the compositions lack halogenated ingredients. In some embodiments, the fire extinguishing composition is free of sugar alcohols. In some embodiments, the fire extinguishing composition consists of aloe vera (and/or aloe vera extract) and water. In some embodiments, the fire extinguishing composition also comprises other ingredients. In some embodiments, the compositions are non-toxic. In some embodiments, the compositions are biodegradable. In some embodiments, the compositions are provided as a gel or as flowable liquid. A variety of extinguishing compositions and systems for deploying those compositions are described below to illustrate various examples that may be employed to achieve one or more desired improvements. These examples are only illustrative and not intended in any way to restrict the general inventions presented and the various aspects and features of these inventions. Furthermore, the phraseology and terminology used herein is for the purpose of description and should not be regarded as limiting. No features, structure, or step disclosed herein is essential or indispensable.

As used herein, in the context of a fire, the term "extinguish" and/or "extinguishing" shall be given its ordinary meaning and can include putting out a fire and/or causing a flame to cease to burn or shine. In some embodiments, extinguishing involves causing a material to stop smoldering.

As used herein, the term "suppress" shall be given its ordinary meaning and can include, preventing or slowing spread of fire, preventing or delaying ignition of fire, lowering temperature of a fire, stopping temperature increase of a fire, and/or causing a burning material to begin to cool.

In some embodiments, the compositions disclosed herein extinguish Class D fires (e.g., put out) and/or to suppress Class D fires (e.g., prevent or slow their spread, prevent or slow their ignition, lower their temperature, and/or stop their temperature increase).

As used herein, the term "non-toxic" shall be given its ordinary meaning and can include an agent or composition that has one or more of the following properties: it can be spread on the skin or fur of mammals without substantial skin reaction (e.g., rash, reddening, irritation, itchiness, hair loss, etc.), quantities (e.g., 10 g, 50 g, 100 g, etc.) can be ingested by mammals without substantial harm (e.g., consumption does not cause nausea, sickness, and/or harm or damage to tissues, such as the liver or kidneys).

As used herein, the term "botanical" shall be given its ordinary meaning and can include materials that are extracted, isolated, or collected from plants.

As used herein, the term "vessel" is used herein in accordance with its ordinary meaning in the art and includes any structure which is capable of holding a composition and being in fluid communication with a dispensing component. Examples may include, but are not limited to, containers such as bottles, vials, canisters, tubes, reservoirs, extinguisher canisters, etc., and materials which may hold the composition such as a sponge, a cloth, a gauze, etc. A dispensing component may be any feature which is capable of being in fluid communication with a vessel and dispensing a composition from the vessel to a burning area of an animal or person. Examples may include, but are not limited to, valves, lumens, orifices, pumps, sponges, cloths, etc. In some embodiments, an extinguishing device may comprise an absorbent material, such as a sponge, cloth, gauze, etc., wherein a liquid or gel composition is absorbed therein. The absorbent material may be saturated, meaning that the material cannot absorb any more liquid, or it may contain a liquid or gel composition but not be saturated. These devices may be further packaged in a film or other sealing material to reduce evaporation or other loss of the liquid.

Class D fires (the U.S. standard for fire classification and class is used throughout this disclosure) involve combustible metals, including but not limited to fires involving alkali metals like lithium and potassium, alkaline earth metals such as magnesium, and Group IV elements such as titanium and zirconium. Metal fires are uniquely hazardous. Often people are unaware of the characteristics of these fires and are not properly prepared to fight them (e.g., suppress or extinguish them). Certain metals also burn on exposure to air or water (for example, sodium), enhancing the risks of fire associated with these metals during attempted containment (e.g., because conventional fire suppressing agents may further fuel the fire). Even small metal fires can spread and become larger fires engulfing and initiating the burning of other, ordinary combustible materials (e.g., causing Class A fires, such as those involving wood, paper, fabric, and most kinds of trash), flammable liquids and gases (e.g., Class B fires, such as those involving solvents, natural gas, etc.), and oils (e.g., Class K fires, such as those involving cooking oils, etc.).

Generally, some bulk combustible metals, such as magnesium, do not represent great fire risks in storage because heat is conducted away from hot spots in an efficient enough manner that the heat of combustion is not maintained (e.g., the heat transferred or distributed to the rest of the metal before a combustion temperature is reached). In bulk form, magnesium, for instance, unlike wood, may require a larger portion of its surface heated to a combustion temperature before it actually ignites. Significant heat energy can be required to ignite a contiguous mass of combustible metal. However, once ignited, magnesium and certain other Class D metals (e.g., alkali metals, potassium, calcium, lithium, metals that violently react with water to form metal oxides, etc.) burn with an intense light and heat, reaching temperatures up to about 5,610° F. (or about 3,100° C. where ° F. can be calculated by multiplying ° C. by 1.8 and adding 32). Generally, metal fires are particularly hazardous when the metal is in the form of particles, machine shavings, or other metal "fines", which combust more rapidly than larger blocks. Metal fires can also be ignited by the same ignition sources that would start other common fires (including ignition by other classes of fires).

Another complicating factor when suppressing or extinguishing Class D fires is that water and other common firefighting agents can fuel metal fires and/or make them worse. For example, water and magnesium can react to form hydrogen gas and MgO. Hydrogen can ignite and further fuel the fire. For that reason, the National Fire Protection Association recommends that metal fires be fought with dry powder extinguishing agents that work by smothering and heat absorption. The most common agents are sodium chloride granules, graphite powder, powdered copper, etc. Additionally complicating matters, these Class D dry powder extinguishers should not be confused with extinguishers that contain dry chemical agents. The two are not the same, and while dry powder should be used to extinguish a metal fire, using a dry chemical extinguisher can be ineffective and/or actually increase the intensity of a metal fire. Moreover, the amount of powder required for fighting large metal fires makes this method unsuitable in certain circumstances. For instance, in "run-flat" tires in certain military vehicles, a magnesium frame is placed within the tire to allow it to operate after the rubber of the tire is punctured. When that magnesium frame ignites (e.g., from an improvised explosive device, etc.), a powder suppressing agent is difficult to deploy on the tire in sufficient quantity to quench the flame. Additionally, when a human is exposed to such a fire (e.g., a passenger in the vehicle), these powders may be ineffective to properly extinguish the flame (because, as the person moves, the powder may not effectively smother the fire). Further, powders can be more difficult to deploy at a safe distance from the fire.

Because the conditions under which human life and man-made materials and equipment might be damaged or destroyed in the event of exposure to excessive heat, combustion or explosion vary considerably, the same temperature suppressing composition will not necessarily be suited to afford protection to personnel and also to all types of material and equipment present in a potential damage incident. Sometimes, for example when military personnel, uniforms, weapons, vehicles and associated equipment are in a combat situation, the welfare of the personnel may also be dependent to significant extent on the performance of their ordinance under the potentially damaging conditions. Consequently, in the development and selection of a temperature suppressing composition or fire extinguishing agent, the paramount issue of welfare of personnel would not necessarily be served by ignoring the danger to the ordinance.

Widely used, but problematic, temperature suppressing compositions currently marketed to suppress Class D fires and protect human life include toxic ingredients such as surfactants, including fluorocarbons (e.g., HALON®). Although halogenated compositions may be mixed with water and sprayed on human skin to provide a cooling effect, halogenated compositions' toxic characteristics prohibit this practice. Furthermore, their deployment within a vehicle may cause frostbite on the face and eyes and requires a level of force which may prove injurious to humans, rupturing eardrums and breaking jawbones. Halon, even at low concentrations, can be fatal to humans if inhaled during an excited state typical of that experienced by military personnel when their vehicle is under enemy fire or after it has hit an improvised explosive device. Because of these known problems, military personnel sometimes disable the halon systems in their vehicles, potentially resulting in additional threat of uncontrolled fire in the vehicle.

While other temperature suppressing compositions exist, including ones with sugar alcohols and water, these compositions do not afford the desired level of protection for applications designed to protect humans from burning and in applications intended to suppress or extinguish Class D fires. For example, these compositions are not sufficiently protective to humans (e.g., allowing burning of the skin, etc.), are not able to extinguish and/or suppress Class D fires sufficiently, are not able to extinguish and/or suppress combinations of Class D fires and other classes of fires, and/or these compositions are not friendly to the environment and/or biodegradable.

One objective in extinguishing a magnesium fire (or other Class D material, e.g., alkali metals like lithium and potassium, alkaline earth metals such as magnesium, and group 4 elements such as titanium and zirconium), is to cool it to the point of non-ignition. Water is not an option as it expands 1700 times its weight as it converts to steam, vaporizing the water molecules before they can even cool metal. Further, as described elsewhere herein, these water molecules can undergo chemical reaction forming hydrogen gas, which is explosive.

Some embodiments of the fire extinguishing compositions and/or methods disclosed herein solve one or more of the above issues and/or other issues not solved by conventional fire extinguishing agents. In some embodiments, the fire extinguishing and/or suppressing compositions disclosed herein are non-toxic, are safe for human contact (or even ingestion), suppress or extinguish Class D fires, and/or suppress or extinguish Class A, B, C, and/or K fires. In some embodiments, the compositions suppress the heat from and/or reduce the temperature of fires generally and/or Class D fires. In some embodiments, the compositions extinguish Class D fires (e.g., put out) and/or to suppress Class D fires (e.g., prevent or slow their spread, prevent or slow their ignition, lower their temperature, and/or stop their temperature increase). Some embodiments pertain to systems including a composition as disclosed herein within a vessel, extinguishers, vehicle systems (e.g., in containers inside a vehicle, inside the wheel-wells, engine compartment, etc.), or in another gel or liquid dispensers.

In some embodiments, as noted above, the fire suppressing and/or extinguishing compositions disclosed herein extinguish Class D fires and/or extinguish and/or suppress Class A fires (e.g., involving materials, such as wood, paper, fabric, plastic, trash, etc.), and/or extinguish and/or suppress Class B (e.g., flammable liquids and gases, such as solvents, natural gas, etc.), and/or extinguish and/or suppress Class K fires (e.g., oils, such as cooking oils, etc.). In some embodiments, the disclosed compositions extinguish and/or suppress Class D, Class A, Class B, and Class K fires simultaneously.

In some embodiments, once a fire is extinguished using a composition as disclosed herein, the previously burning material (e.g., the extinguished material) rapidly cools. In some embodiments, after extinguishing the previously burning material is almost instantly or substantially instantly cool to the touch. In some embodiments, after extinguishing, the extinguished material is cool to the touch (e.g., by a hand or by a body part) within equal to less than about: 1 second (s), 5 s, 10 s, 30 s, or ranges including and/or spanning the aforementioned values. In some embodiments, after extinguishing, the extinguished material reaches temperature less than about room temperature (less than about 74° F.) within equal to less than about: 1 s, 5 s, 10 s, 30 s, 1 minute, 5 minutes, or ranges including and/or spanning the aforementioned values. In some embodiments, after extinguishing, the extinguished material reaches a temperature less than about 150° F. (and/or a temperature that is safe to touch with skin) within equal to less than about: 1 s, 5 s, 10 s, 30 s, 1 minute, 5 minutes, or ranges including and/or spanning the aforementioned values.

In some embodiments, application of the fire extinguishing composition/temperature suppressing compositions disclosed herein substantially prevents the heating of an object. For example, by coating a structure (e.g. a building) or an object (e.g., a vehicle, furniture, cloth, or other textile) with a composition disclosed herein, temperature suppression can be achieved. In some embodiments, when directly heated with a torch (e.g., propane, MAPP, acetylene, oxygen, one having a flame of about 3800° F., etc.) for a period of about 1 to about 12 minutes (e.g., about 1 minute, about 2 minutes, about 3 minutes, about 4 minutes, etc.), the temperature of a surface coated with a composition as disclosed herein rises by less than or equal to about: 5° F., 10° F., 20° F., 50° F., 100° F., 150° F., 200° F., 250° F., or ranges including and/or spanning the aforementioned values. In some embodiments, as disclosed elsewhere herein, the fire extinguishing composition/temperature suppressing compositions can be used as paint additives or other coating additives for objects.

In some embodiments, the fire suppressing and/or extinguishing composition comprises a temperature suppressing agent and/or a water delivery agent. In some embodiments, the temperature suppressing agent can act as a water delivery agent preventing and/or inhibiting the evaporation of water so that it can be delivered to the burning material. In some embodiments, the temperature suppressing agent delivers water to a fire (e.g., a Class D fire) and simultaneously prevents the water from further fueling the fire. In some embodiments, the temperature suppressing agent delivers water that has been added to the temperature suppressing agent during preparation of the fire suppressing and/or extinguishing composition and/or water that is residual in the suppressing agent (e.g., water that is not added to the temperature suppressing agent). In some embodiments, the temperature suppressing agent has no water added.

In some embodiments, the fire suppressing and/or extinguishing composition is prepared as a concentrate (e.g., a concentrated solution and/or concentrated mixture). In some embodiments the concentrate is a gel (e.g., a flowable gel, a hydrogel, a thixotropic gel, etc.). In some embodiments the concentrate comprises water. In some embodiments, the fire suppressing and/or extinguishing composition is prepared by diluting a concentrate with water to form a wetting composition. For example, in some embodiments, a concentrate (which may already comprise some water) is diluted prior to use in, for example, a fire extinguisher (or other device for deploying the fire extinguishing agent). In some embodiments, the concentrate is used without dilution to extinguish and/or suppress fire. In other words, in some embodiments, the fire suppressing and/or extinguishing composition is the concentrate. In some embodiments, the composition has a viscosity of equal to or less than about: 10000 cP, 5000 cP, 1000 cP, 500 cP, 100 cP, 5 cP, or ranges including and/or spanning the aforementioned values.

Some embodiments comprise a temperature suppressing agent and/or water delivery agent. In some embodiments, without being bound to any particular theory, it is believed that the temperature suppressing agent of the fire suppressing and/or extinguishing composition acts as a water delivery agent. In some embodiments, as disclosed elsewhere herein, the temperature suppressing agent comprises an organic polymeric material. In some embodiments, as disclosed elsewhere herein, the temperature suppressing agent comprises and/or consists of a botanical material. In some embodiments, the botanical material is a gel (e.g., a botanical gel, etc.). In some embodiments, the botanical material is aloe vera and/or an extract of aloe vera. Without being bound to a particular mechanism, it is believed that the botanical material (e.g., aloe vera and/or an extract thereof) acts as a temperature reducing agent and/or water delivering material in the fire suppressing and/or extinguishing composition. In some embodiments, the botanical material is powdered and/or concentrated. In some embodiments, powdered botanical materials can be reconstituted (e.g., mixed with a diluent such as water) prior to its use in the composition.

In some embodiments, the weight percent of botanical material (e.g., aloe vera, aloe vera extract, reconstituted aloe vera extract, etc.) in the fire suppressing and/or extinguishing composition concentrate is equal to or at least about: 0.5%, 1%, 5%, 10%, 25%, 50%, 70%, 95%, or ranges including and/or spanning the aforementioned values. In some embodiments, the weight percent of botanical material (e.g., aloe vera, aloe vera extract, reconstituted aloe vera extract, etc.) in the fire suppressing and/or extinguishing composition concentrate is equal to or less than about: 0.5%, 1%, 5%, 10%, 25%, 50%, 70%, 75%, 80%, 85%, 95%, or ranges including and/or spanning the aforementioned values. In some embodiments, the concentrated fire suppressing and/or extinguishing composition consists of aloe vera or an extract of aloe vera and/or water.

In some embodiments, as disclosed elsewhere herein, a composition concentrate is prepared which can be diluted prior to use. In some embodiments, the weight percent of botanical material (e.g., aloe vera, aloe vera extract, reconstituted aloe vera extract, etc.) in the fire suppressing and/or extinguishing composition after dilution (e.g., with water) is equal to or at least about: 0.1%, 0.2%, 0.5%, 1.0%, 2.5%, 5.0%, 7.0%, 9.5%, or ranges including and/or spanning the aforementioned values. In some embodiments, the weight percent of botanical material (e.g., aloe vera, aloe vera extract, reconstituted aloe vera extract, etc.) in the fire suppressing and/or extinguishing composition after dilution (e.g., with water) is equal to or less than about: 0.1%, 0.2%, 0.5%, 1.0%, 2.5%, 5.0%, 7.0%, 9.5%, or ranges including and/or spanning the aforementioned values.

In some embodiments, instead of or in addition to the botanical material, the composition comprises a saccharide material. In some embodiments, the saccharide material can be used as a thickening agent, as a temperature suppressing agent, and/or as water delivery agent. In some embodiments, the saccharide material is a polysaccharide. In some embodiments, the botanical material comprises a polysaccharide and/or is a polysaccharide (e.g., a hydrogel or reconstituted polysaccharide). In some embodiments, the polysaccharide is hydrophilic. In some embodiments, the polysaccharide is amphiphilic. In some embodiments, the polysaccharide is crosslinkable (e.g., through ionic bonding with, for example, calcium or covalent bonding with, for example, multifunctional crosslinking agents). In some embodiments, the polysaccharide is a natural polysaccharide. In some embodiments, the polysaccharide is a synthetic polysaccharide.

In some embodiments, the polysaccharide is selected from one or more of acemannan, alginate, chitosan, a cellulose, callose, laminarin, chrysolaminarin, xylan, arabinoxylan, mannan, fucoidan, galactomannan hydroxypropyl cellulose, and/or hydroxymethylcellulose. In some embodiments, the polysaccharide is selected from one or more of a cellulose, a cellulose derivative, insulin guar, karats, pectin, agar, algin, carrageenan, furcellaran, gellan, curdlan, dextran, cellulon, pullulan, carboxymethylcellulose (e.g., the free acid, sodium salt, potassium salt, etc.), methylcellulose, cyclodextrins, polydextrose, glycogen, hyaluronic acid (HA), and/or chitin. In some embodiments, the polysaccharide is acemannan.

In some embodiments, the polysaccharide comprises or is a cellulosic material. In some embodiments, the cellulosic material is one or more of methylcellulose, carboxymethylcellulose (including salts thereof such as sodium carboxymethylcellulose), gellan gum, hydroxyethyl cellulose, hydroxypropyl methylcellulose, ethylcellulose, and/or a hydrolyzed cellulose.

It has been noted that, by adding botanical material(s) and/or polysaccharide materials to the fire suppressing and/or extinguishing composition, a cooling effect occurs when a fire is extinguished or suppressed. Without being bound to a particular mechanism, it is believed that the botanical material (e.g., aloe vera plant extract, a botanical gel or extract) removes heat from the fire and encapsulates the fuel. In some embodiments, it is believed that the botanical and/or polysaccharide helps prevent re-ignition by encapsulating and/or cooling the fuel source.

In some embodiments, botanical material is a material taken directly from a plant without further processing (e.g., concentration or treatment). In some embodiments, the extract comprises a material that has been further processed (e.g., by concentration, drying, purification, isolation, etc.). In some embodiments, aloe vera in its gel form (e.g., aloe vera juice form) is used as a botanical material base for the composition. In some embodiments, the aloe vera comprises and/or consists of pure aloe barbadensis leaf juice (e.g., a botanical gel). In some embodiments, the aloe vera comprises and/or consists of pure aloe barbadensis leaf gel. In some embodiments, the botanical material is an aloe extract such as one or more of BIALOE®, Naturaloe, and/or Aloecorp bioactive aloe. In some embodiments, the aloe vera comprises and/or consists of aloe barbadensis leaf gel, semi-solid liquid, or liquid aloe vera plant extract. In some embodiments, the aloe vera comprises and/or consists of an aloe vera extract powder (e.g., BIALOE®). In some embodiments, as discussed elsewhere herein, the botanical material comprises and/or is BIALOE® and/or reconstituted BIALOE® powder. BIALOE® is a commercial aloe extract available from Lorand Laboratories. In some embodiments, BIALOE® has an average acemannan wt % of 18%. In some embodiments, about 15.5% of the acemannan fraction in BIALOE® is less than 400 KDa and about 7.1% of the acemannan fraction is less than 50 kDa. In some embodiments, BIALOE® has a polysaccharide content of about 20%. In some embodiments, BIALOE® has a full spectrum of molecular weight polysaccharides. In some embodiments, as described elsewhere herein, the botanical material powder can be reconstituted with water to prepare the temperature suppressing agent and/or a water delivery concentrate.

In some embodiments, the amount of temperature suppressing agent and/or water delivery agent (such as a botanical material) in the composition is expressed as a weight % of the dry material (e.g., a powdered aloe extract, BIALOE®, etc.) in composition. For example, where 1 g of dry botanical material is added to 99 g of water, the weight percent of the botanical material that is 1% (1 g dry material/100 g total composition×100). In some embodiments, the weight percent of temperature suppressing agent and/or water delivery agent (e.g., botanical material, aloe extract powder, BIALOE®, etc.) in the fire suppressing and/or extinguishing composition concentrate is equal to or less than about: 0.01%, 0.1%, 0.25%, 0.3%, 0.5%, 1.0%, 4.0%, 5.0% 10%, 25%, or ranges including and/or spanning the aforementioned values. In some embodiments, the weight percent of temperature suppressing agent and/or water delivery agent in the composition concentrate is equal to or at least about: 0.001%, 0.01%, 0.03%, 0.05%, 0.1%, 0.25%, 0.50%, 1.0%, 2.5%, 5.0%, 7.5%, or ranges including and/or spanning the aforementioned values. In some embodiments, the weight percent of temperature suppressing agent and/or water delivery agent in the dilute fire suppressing and/or extinguishing composition is equal to or less than about: 0.001%, 0.01%, 0.03%, 0.05%, 0.10%, 0.40%, 0.50% 1.0%, 2.5%, or ranges including and/or spanning the aforementioned values. In some embodiments, the weight percent of temperature suppressing agent and/or water delivery agent in the dilute composition is equal to or at least about: 0.0001%, 0.001%, 0.003%, 0.005%, 0.01%, 0.10%, 0.25%, 0.50%, 0.75%, or ranges including and/or spanning the aforementioned values. Where a plurality of temperature suppressing agents and/or water delivery agents are used (e.g., 2, 3, 4, 5, or more), their individual weight % values can be independently selected from the weight % values disclosed herein. In some embodiments, the weight percent of aloe vera powder (or other powdered botanical material or other temperature suppressing agent and/or a water delivery agent) in the concentrated fire suppressing and/or extinguishing composition is equal to or at least about: 0.01%, 0.1%, 0.25%, 0.3%, 0.5%, 1.0%, 4.0%, 5.0% 10%, 25%, 50%, 75%, or ranges including and/or spanning the aforementioned values.

In some embodiments, as mentioned above, where an aloe vera extract is used (e.g., a powdered extract, such as BIALOE®), it can be reconstituted before use. In some embodiments, for example, 0.228 oz of powdered aloe plant extract (e.g., BIALOE®) is mixed with 60 oz of distilled water to prepare the botanical material for use in the fire suppressing and/or extinguishing composition. In some embodiments, the weight percent (wt %) of powdered aloe vera extract (e.g., BIALOE) in water used to form the botanical material (e.g., a reconstituted botanical material) is equal to or less than about: 0.01%, 0.1%, 0.3%, 0.5%, 1.0%, 4.0%, 5.0% 10%, 25%, 50%, 75%, or ranges including and/or spanning the aforementioned values. In some embodiments, the weight percent of reconstituted botanical material in the concentrate or in the diluted formulation is as described elsewhere herein. For example, in some embodiments, as described elsewhere herein, the wt % of botanical material (e.g., reconstituted aloe vera extract, etc.) in the fire suppressing and/or extinguishing composition concentrate is equal to or less than about: 5%, 10%, 25%, 50%, 70%, 75%, 80%, 85%, 95%, or ranges including and/or spanning the aforementioned values. In some embodiments, the weight percent of botanical material (e.g., reconstituted aloe vera extract, etc.) in the fire suppressing and/or extinguishing composition after dilution (e.g., with water) is equal to or less than about: 0.1%, 0.2%, 0.5%, 1.0%, 2.5%, 5.0%, 7.0%, 9.5%, or ranges including and/or spanning the aforementioned values. In some embodiments, the weight percent (wt %) of powdered aloe vera extract (e.g., BIALOE) in the fire suppressing and/or extinguishing composition after dilution (e.g., with water) is equal to or less than about: 0.001%, 0.01%, 0.03%, 0.05%, 0.1%, 1.0%, 2.5%, 5.0%, 7.5%, or ranges including and/or spanning the aforementioned values.

In some embodiments, as disclosed elsewhere herein, the temperature suppressing agent and/or a water delivery agent of the fire suppressing and/or extinguishing composition comprises botanical powder (e.g., extracted material from an aloe vera plant, such as BIALOE®, etc.). In some embodiments, the powder is an aloe vera powder. In some embodiments, the aloe vera powder is prepared by drying organic inner leaf aloe vera or aloe vera leaf juice. In some embodiments, the botanical powder is prepared by drying organic plant material. In some embodiments, aloe vera leaf juice is dehydrated and then subject to a milling or powderizing process to provide aloe vera powder. In some embodiments, the temperature suppressing agent and/or a water delivery agent (e.g., powdered aloe vera extract, BIALOE®, acemannan, etc.), or the plurality of agents, is mixed with water (e.g., reconstituted) to prepare the concentrated temperature suppressing agent and/or a water delivery agent.

In some embodiments, the weight percent of aloe vera powder in the concentrated fire suppressing and/or extinguishing composition can be a value as disclosed elsewhere herein and/or can be equal to or at least about: 0.01%, 0.1%, 0.25%, 0.3%, 0.5%, 1.0%, 4.0%, 5.0% 10%, or ranges including and/or spanning the aforementioned values. In some embodiments, the weight percent of aloe vera powder (or other powdered agent temperature suppressing agent and/or a water delivery agent) in the concentrated fire suppressing and/or extinguishing composition can be a value as disclosed elsewhere herein and/or can be equal to or less than about: 0.001%, 0.01%, 0.1%, 0.3%, 0.5%, 1.0%, 4.0%, 5.0% 10%, or ranges including and/or spanning the aforementioned values. As an illustration, where the fire suppressing and/or extinguishing composition consists of only 5 g of aloe vera powder and 95 g water, the aloe vera powder is provided at a weight percent of 5% and the concentrated fire suppressing and/or extinguishing composition comprises water at a weight percent of 95%. In some embodiments, as disclosed elsewhere herein, water is added to the powdered temperature suppressing agent and/or a water delivery agent (or gel) as a reconstituting agent. In some embodiments, the weight percent of water in the reconstituted temperature suppressing agent and/or a water delivery agent is equal to or at least about: 40%, 60%, 80%, 90%, 98%, 99.9%, 99.99% or ranges including and/or spanning the aforementioned values. In some embodiments, the weight percent of aloe vera powder (or other temperature suppressing agent and/or a water delivery agent powdered agent) in the diluted fire suppressing and/or extinguishing composition is equal to or at least about: 0.001%, 0.01%, 0.03%, 0.05%, 0.1%, 1.0%, 2.5%, 5.0%, 7.5%, or ranges including and/or spanning the aforementioned values.

In some embodiments, the amount of polysaccharide in the fire suppressing and/or extinguishing composition is expressed as a weight % of the dry material in the formulation. In some embodiments, the weight percent of polysaccharide in the fire suppressing and/or extinguishing composition concentrate is equal to or less than about: 0.01%, 0.1%, 0.25%, 0.3%, 0.5%, 1.0%, 4.0%, 5.0% 10%, 25%, or ranges including and/or spanning the aforementioned values. In some embodiments, the weight percent of polysaccharide in the composition concentrate is equal to or at least about: 0.001%, 0.01%, 0.03%, 0.05%, 0.1%, 0.25%, 0.50%, 1.0%, 2.5%, 5.0%, 7.5%, or ranges including and/or spanning the aforementioned values. In some embodiments, the weight percent of polysaccharide in the composition concentrate is equal to or at least about: 0.001%, 0.01%, 0.03%, 0.05%, 0.1%, 0.25%, 0.50%, 1.0%, 2.5%, 5.0%, or ranges including and/or spanning the aforementioned values. In some embodiments, the weight percent of polysaccharide in the dilute fire suppressing and/or extinguishing composition is equal to or less than about: 0.001%, 0.01%, 0.03%, 0.05%, 0.10%, 0.40%, 0.50% 1.0%, 2.5%, or ranges including and/or spanning the aforementioned values. In some embodiments, the weight percent of polysaccharide in the dilute composition is equal to or at least about: 0.0001%, 0.001%, 0.003%, 0.005%, 0.01%, 0.10%, 0.25%, 0.50%, 0.75%, or ranges including and/or spanning the aforementioned values. Where a plurality of polysaccharides are used (e.g., 2, 3, 4, 5, or more), their individual weight % values can be independently selected from the weight % values disclosed herein.

In some embodiments, the amount of cellulosic material in the fire suppressing and/or extinguishing composition is expressed as a weight % of the dry material. In some embodiments, the weight percent of cellulosic material in the fire suppressing and/or extinguishing composition concentrate is equal to or less than about: 0.01%, 0.1%, 0.25%, 0.3%, 0.5%, 1.0%, 4.0%, 5.0% 10%, 25%, or ranges including and/or spanning the aforementioned values. In some embodiments, the weight percent of cellulosic material in the composition concentrate is equal to or at least about: 0.001%, 0.01%, 0.03%, 0.05%, 0.1%, 0.25%, 0.50%, 1.0%, 2.5%, 5.0%, 7.5%, or ranges including and/or spanning the aforementioned values. In some embodiments, the weight percent of cellulosic material in the dilute fire suppressing and/or extinguishing composition is equal to or less than about: 0.001%, 0.01%, 0.03%, 0.05%, 0.10%, 0.40%, 0.50% 1.0%, 2.5%, or ranges including and/or spanning the aforementioned values. In some embodiments, the weight percent of cellulosic material in the dilute composition is equal to or at least about: 0.0001%, 0.001%, 0.003%, 0.005%, 0.01%, 0.10%, 0.25%, 0.50%, 0.75%, or ranges including and/or spanning the aforementioned values. Where a plurality of cellulosic materials are used (e.g., 2, 3, 4, 5, or more), their individual weight % values can be independently selected from the weight % values disclosed herein.

In some embodiments, the fire suppressing and/or extinguishing composition comprises an acemannan source (e.g., aloe vera, alternative plant sources, etc.) and/or acemannan (e.g., a dissolved powder extract of acemannan). Acemannan is a D-isomer mucopolysaccharide in aloe vera leaves and is a hydrophilic polymer. Acemannan is recognized by the FDA as natural product. It can be isolated from natural aloe vera to form a process stabilized powder that contains all the active characteristics of the complex carbohydrates or acetylated mannans and found in fresh aloe vera gel. Aloe vera (and acemannan) also contains organic acids (e.g., galacturonic acid, etc.), that exhibit and/or lend unique properties to the formulation (e.g., good viscosity, high swelling capabilities, water retention, etc.). Without being bound to any mechanism, it is believed that acemannan functions as a temperature reducing agent and/or water delivering material in the fire suppressing and/or extinguishing composition.

In some embodiments, the weight percent of dry acemannan used in the concentrated fire suppressing and/or extinguishing composition is as described above for the temperature suppressing agent and/or a water delivery agent. In some embodiments, the wt % of acemannan in the fire suppressing and/or extinguishing composition concentrate is equal to or less than about: 0.01%, 0.05%, 0.1%, 0.25%, 0.5%, 1%, 2.5%, 5%, 10%, 25%, or ranges including and/or spanning the aforementioned values. In some embodiments, the wt % of acemannan in the fire suppressing and/or extinguishing composition concentrate is equal to or greater than about: 0.01%, 0.05%, 0.1%, 0.2%, 0.5%, 1.0%, 2.5%, 5.0%, 7.0%, 9.5%, or ranges including and/or spanning the aforementioned values. In some embodiments, the wt % of acemannan in the fire suppressing and/or extinguishing composition after dilution (e.g., with water) is equal to or less than about: 0.001%, 0.01%, 0.03%, 0.05%, 0.1%, 1.0%, 2.5%, 5.0%, 7.5%, or ranges including and/or spanning the aforementioned values.

In some embodiments, the concentrate comprises a hydrocolloid (e.g., gelling agent, a hydrogel-forming, and/or hydrophilic polymer) capable of swelling and delivering water to the fire fuel source. In some embodiments, the hydrocolloid is a polysaccharide as disclosed elsewhere herein. In some embodiments, the temperature suppressing agent and/or a water delivery agent of the concentrate comprises a hydrogel-forming and/or hydrophilic polymer. Without being bound to any mechanism, it is believed that hydrogel-forming and/or hydrophilic polymers function as temperature reducing agents and/or water delivering materials in the fire suppressing and/or extinguishing composition. These can be used in addition to, or instead of acemannan and/or aloe vera. In some embodiments, the weight percent of a wet hydrogel-forming and/or hydrophilic polymer(s) (e.g., the weight percent of hydrated hydrogel) in the fire suppressing and/or extinguishing concentrate is equal to or at least about: 10%, 20%, 40%, 60%, 70%, 80%, 90%, or ranges including and/or spanning the aforementioned values. In some embodiments, the wt % hydrogel-forming and/or hydrophilic polymer(s) in the fire suppressing and/or extinguishing concentrate is equal to or at least about: 0.01%, 0.1%, 0.3%, 0.5%, 1.0%, 10%, 25%, 50%, 75%, 80%, 95%, or ranges including and/or spanning the aforementioned values. In some embodiments, the weight percent of the hydrogel-forming and/or hydrophilic polymer in the concentrated fire suppressing and/or extinguishing composition is equal to or at least about: 0.001%, 0.01%, 0.03%, 0.05%, 0.10%, 1%, 5%, 10%, or ranges including and/or spanning the aforementioned values. In some embodiments, the wt % hydrogel-forming and/or hydrophilic polymer(s) in the diluted fire suppressing and/or extinguishing concentrate is equal to or at least about: 0.001%, 0.01%, 0.03%, 0.05%, 0.10%, 1.0%, 2.5%, 5.0%, 7.5%, or ranges including and/or spanning the aforementioned values.

In some embodiments, the hydrogel-forming and/or hydrophilic polymer is a polysaccharide. In some embodiments, the hydrogel-forming and/or hydrophilic polymer is the polysaccharide as disclosed elsewhere herein. In some embodiments, the hydrogel forming and/or hydrophilic polymer is not a polysaccharide. In some embodiments, the hydrogel-forming and/or hydrophilic polymer comprises one or more of acemannan, hyaluronic acid, collagen, starch, alginate, agarose, or the like.

In some embodiments, the acemannan, aloeride, polysaccharide, cellulosic material, aloe extract components (and/or hydrogel-forming and/or hydrophilic polymers) are selected based on their molecular weight. In some embodiments, the molecular weight of the hydrogel-forming and/or hydrophilic polymers in the fire suppressing and/or extinguishing composition have a mass in Daltons (Da) of equal to or at least about: 10,000, 50,000, 100,000, 1,000,000, 1,300,000, 2,000,000, 3,000,000, 4,000,000, 5,000,000, 6,000,000, 7,000,000, or ranges including and/or spanning the aforementioned values.

In some embodiments, the fire suppressing and/or extinguishing composition (e.g., the concentrate or diluted concentrate) can comprise one or more thickening agents, one or more surfactants, one or more humectants, one or more agents that prevent the crystallization of water (e.g., an antifreeze agent), and/or one or more pH adjusting agents. It should be appreciated that these ingredients, individually or collectively, may or may not be present in the fire suppressing and/or extinguishing composition. Thus, as described above, in some embodiments, the fire suppressing and/or extinguishing composition lacks a thickening agent, a surfactant, a humectant, an agent that prevents the crystallization of water (e.g., an antifreeze agent), and/or a pH adjusting agent.

As disclosed elsewhere herein, in some embodiments, the composition comprises one or more thickening agents. In some embodiments, the thickening agent comprises a polysaccharide and/or a cellulosic material (such as cellulose and their derivatives) as disclosed elsewhere herein. In some embodiments, the thickening agent comprises one or more of gellan gum, guar gum, carbomer (e.g., Carbomer 940/980), xanthan gum, gum arabic, pectin, acacia gum, dried exudate from the stems and branches of the acacia tree (e.g., polysaccharides, starches, glucuronic acid, galacturonic acid, etc.), and/or hydroxyl propyl guar (e.g., which is a non-ionic polymer made of naturally occurring guar (*Cyanopsis tetragonoloba*)). These gums also have emulsifying properties for oil in water emulsions (which helps with the encapsulation properties of the formulation). In some embodiments, the thickening agent comprises a polysaccharide or cellulosic material as disclosed above. For example, in some embodiments, a botanical material is provided as the temperature suppressing agent and/or a water delivery agent and a polysaccharide as a thickener. In some embodiments, one polysaccharide is used as the temperature suppressing agent and/or a water delivery agent and another polysaccharide as a thickener. In some embodiments, a single or multiple polysaccharides (2, 3, 4, 5, or more) are used together to serve a dual purpose as a temperature suppressing agent and/or a water delivery agent and thickener.

In some embodiments, the weight percent of the thickening agent or thickening agents in the fire suppressing and/or extinguishing concentrate, individually or collectively, is equal to or at least about: 0.01%, 0.1%, 1.0%, 2.5%, 5.0%, 10%, 20%, 25%, 30%, or ranges including and/or spanning the aforementioned values. In some embodiments, the weight percent of the thickening agent or thickening agents in the fire suppressing and/or extinguishing concentrate, individually or collectively, is equal to or less than about: 0.01%, 0.1%, 0.3%, 0.5%, 1.0%, 2.5%, 5.0%, 10%, 20%, 25%, 30%, or ranges including and/or spanning the aforementioned values. In some embodiments, the weight percent of the thickening agent or thickening agents in the diluted fire suppressing and/or extinguishing composition, individually or collectively, is equal to or at least about: 0.001%, 0.01%, 0.025%, 0.05%, 0.1%, 0.5%, 1.0%, 2.0%, 2.5%, 3.0%, or ranges including and/or spanning the aforementioned values. In some embodiments, the weight percent of the thickening agent or thickening agents in the diluted fire suppressing and/or extinguishing composition, individually or collectively, is equal to or less than about: 0.001%, 0.01%, 0.025%, 0.05%, 0.1%, 0.5%, 1.0%, 2.0%, 2.5%, 3.0%, or ranges including and/or spanning the aforementioned values.

In some embodiments, as disclosed elsewhere herein, a soluble or swellable polysaccharide is used as the thickening agent (e.g., xanthan gum, a cellulosic material, etc.) because its water solubility and its ability to swell (e.g., as a swellable thickening agent). In some embodiments, thickening agents (e.g., as a swellable thickening agent) aid in causing a foam to form a gel when the composition comes into contact with a polar hydrophilic liquid (alcohols, ketones, etc.). In some embodiments, the thickening agent acts as a barrier toward the fuel vapors and liquids and prevents the foam blanket from breaking. In some embodiments, 1,3-propane diol is used as a thickening agent. In some embodiments, 1,3-propandiol is not used as a thickening agent.

While several embodiments described herein comprise a thickening agent, in some embodiments, the fire suppressing and/or extinguishing composition lacks a thickening agent, including any one or more of the thickening agents disclosed elsewhere herein.

As disclosed elsewhere herein, in some embodiments, the composition comprises one or more surfactants. In some embodiments, the surfactant reduces water surface tension and/or aids in foaming of the composition. In some embodiments, the surfactant helps the composition form a foam blanket when mixed with air (e.g., when the composition is deployed). In some embodiments, it has been noted that fire suppressing and/or extinguishing compositions comprising surfactants can extinguish fires faster than those without surfactants. In some embodiments, the surfactant comprises one or more of cocobetaine (e.g., cocamidopropyl betaine), decyl glycoside, sodium lauroyl lactylate, sodium oleate, potassium laureate, alpha olein sulfonate, cocoglucose, sodium cocoamphoceate (amphoteric), lauryl glycoside (non-ionic), sodium cocoyl glutamate (anionic), and/or sodium lauryl glucose carboxylate (anionic). In some embodiments, anionic, cationic, and/or neutral (non-ionic) surfactants can be used. In some embodiments, the weight percent of the surfactant or surfactants in the fire suppressing and/or extinguishing composition concentrate, individually or collectively, is equal to or at least about: 1%, 4%, 5%, 10%, 15%, 20%, 30%, 40%, or ranges including and/or spanning the aforementioned values. In some embodiments, the weight percent of the surfactant or surfactants in the fire suppressing and/or extinguishing composition concentrate, individually or collectively, is equal to or less than about: 1%, 4%, 5%, 10%, 15%, 20%, 30%, 40%, or ranges including and/or spanning the aforementioned values. In some embodiments, the weight percent of the surfactant or surfactants in the diluted fire suppressing and/or extinguishing composition, individually or collectively, is equal to or at least about: 0.1%, 0.4%, 0.5%, 1.0%, 1.5%, 2.0%, 3.0%, 4.0%, or ranges including and/or spanning the aforementioned values. In some embodiments, the weight percent of the surfactant or surfactants in the diluted fire suppressing and/or extinguishing composition, individually or collectively, is equal to or less than about: 0.1%, 0.4%, 0.5%, 1.0%, 1.5%, 2.0%, 3.0%, 4.0%, or ranges including and/or spanning the aforementioned values. In some embodiments, the fire suppressing and/or extinguishing composition lacks a surfactant.

In some embodiments, cocobetaine is selected as the surfactant (or as one of the surfactants) because of its high level of biodegradability and biocompatibility. In some embodiments, cocobetaine has both wettability and foaming properties (for foam and foam stability). In some embodiments, cocobetaine is selected as the surfactant due to its a mild amphoteric properties and/or its compatibility with anionic, non-ionic and other cationic surfactants. Cocobetaine is also a good foam booster and it is derived from coconut oil and is water soluble (with a pH of 5 to 6). In some embodiments, the surfactant is decyl glucoside sodium lauroyl lactylate. Decyl glucoside sodium lauroyl lactylate is a non-ionic surfactant blend consisting of decyl glucoside and sodium lauroyl lactylate. Decyl glucoside can be made from coconut and corn starch. Sodium laurel lactylate is the sodium salt of lactic acid. In some embodiments, sodium oleote and/or or potassium laurate can used as a surfactant.

In some embodiments, a surfactant comprises a mild anionic, foaming, and/or emulsifying surfactant (e.g., alpha olein sulfonate). Alpha olein sulfonate is made primarily from coconut oils. In some embodiments, the surfactant has a wetting effect, foam booster properties, and/or has good compatibility with other surfactants including non-ionic, amphoteric or anionic co surfactants. In some embodiments, the weight percent of alpha olein sulfonate in the concentrated fire suppressing and/or extinguishing composition is equal to or less than about: 1%, 4%, 5%, 10%, 15%, 20%, 30%, 40%, or ranges including and/or spanning the aforementioned values. In some embodiments, the weight percent of alpha olein sulfonate in the diluted fire suppressing and/or extinguishing composition is equal to or less than about: 0.1%, 0.4%, 0.5%, 1.0%, 1.5%, 2.0%, 3.0%, 4.0%, or ranges including and/or spanning the aforementioned values. In some embodiments, the weight percent of the surfactant(s) (e.g., cocoglucose, sodium cocoamphoceate, lauryl glycoside, sodium cocoyl glutamate, and/or sodium lauryl glucose carboxylate, individually or collectively) in the concentrated fire suppressing and/or extinguishing composition is equal to or less than about: 1%, 4%, 5%, 10%, 15%, 20%, 30%, 40%, or ranges including and/or spanning the aforementioned values. In some embodiments, the weight percent of the surfactant(s) (e.g., cocoglucose, sodium cocoamphoceate, lauryl glycoside, sodium cocoyl glutamate, and/or sodium lauryl glucose carboxylate, individually or collectively) in the diluted fire suppressing and/or extinguishing composition is equal to or at least about: 0.1%, 0.4%, 0.5%, 1.0%, 1.5%, 2.0%, 3.0%, 4.0%, or ranges including and/or spanning the aforementioned values. In some embodiments, the weight percent of the surfactant(s) (e.g., cocoglucose, sodium cocoamphoceate, lauryl glycoside, sodium cocoyl glutamate, and/or sodium lauryl glucose carboxylate, individually or collectively) in the concentrated or diluted fire suppressing and/or extinguishing composition is as disclosed elsewhere herein.

While several embodiments described herein comprise a surfactant, in some embodiments, the fire suppressing and/or extinguishing composition lacks a surfactant, including any one or more of the surfactants disclosed elsewhere herein.

As disclosed elsewhere herein, in some embodiments, the composition comprises one or more humectants. Some embodiments of the composition comprise one or more emollients (e.g., humectants and/or wetting agents). In some embodiments, the humectant comprises one or more of 1,3-propane diol, 1,2-propane diol, and/or isopropyl isostearate. In some embodiments, the composition lacks 1,2-propane diol (e.g., propylene glycol). In some embodiments, the weight percent of the humectant or humectants in the concentrated fire suppressing and/or extinguishing composition, individually or collectively, is equal to or at least about: 1%, 5%, 10%, 15%, 20%, 25%, 35%, or ranges including and/or spanning the aforementioned values. In some embodiments, the weight percent of the humectant or humectants in the concentrated fire suppressing and/or extinguishing composition, individually or collectively, is equal to or less than about: 1%, 5%, 10%, 13%, 15%, 20%, 25%, 35%, or ranges including and/or spanning the aforementioned values. In some embodiments, the weight percent of the humectant or humectants in the diluted fire suppressing and/or extinguishing composition, individually or collectively, is equal to or at least about: 0.05%, 0.1%, 0.5%, 1.0%, 1.5%, 2.0%, 2.5%, 3.5%, or ranges including and/or spanning the aforementioned values. In some embodiments, the weight percent of the humectant or humectants in the diluted fire suppressing and/or extinguishing composition, individually or collectively, is equal to or less than about: 0.05%, 0.1%, 0.5%, 1.0%, 1.5%, 2.0%, 2.5%, 3.5%, or ranges including and/or spanning the aforementioned values. In some embodiments, where used, the 1,3-propane diol also adds fluidity properties, anti-freeze properties, and/or a preservative boosting efficacy. In some embodiments, it is believed that 1,3-propane diol advantageously affects the conformation of the polysaccharide or botanical in solution, allowing it to expand and deliver more water more effectively. In some embodiments, the humectant comprises glycerol. In some embodiments, the humectant lacks glycerol. In some embodiments, the fire suppressing and/or extinguishing composition lacks a humectant.

While several embodiments described herein comprise a humectant, in some embodiments, the fire suppressing and/or extinguishing composition lacks a humectant, including any one or more of the humectants disclosed elsewhere herein.

As disclosed elsewhere herein, in some embodiments, the composition comprises one or more pH adjusting agents. In some embodiments, the pH adjusting agent comprises one or more of triethylamine, triethanolamine, sodium gluconate, gluconic acid, and/or citric acid. Sodium gluconate is the sodium salt of gluconic acid. In addition to pH adjusting capabilities, sodium gluconate has chelating properties allowing it to bind metals ions (e.g., iron, copper, etc.). In some embodiments, sodium gluconic acid has chelating properties over a wide pH range and/or it also acts as a pH regulator as well as a humectant. Citric acid is naturally produced (e.g., by fermentation of carbohydrates) and is another biocompatible pH adjusting agent. In some embodiments, the weight percent of the pH adjusting agent or pH adjusting agents in the fire suppressing and/or extinguishing concentrate, individually or collectively, is equal to or at least about: 0.01%, 0.1%, 1%, 2%, 3%, 5%, or ranges including and/or spanning the aforementioned values. In some embodiments, the weight percent of the pH adjusting agent or pH adjusting agents in the diluted fire suppressing and/or extinguishing, individually or collectively, is equal to or at least about: 0.001%, 0.01%, 0.1%, 0.2%, 0.3%, 0.5%, or ranges including and/or spanning the aforementioned values. In some embodiments, the pH adjusting agent (e.g., acidulant) also has chelating effects as well as buffering properties (helps to maintain pH). In some embodiments, the fire suppressing and/or extinguishing composition lacks a pH adjusting agent.

While several embodiments described herein comprise a pH adjusting agent, in some embodiments, the fire suppressing and/or extinguishing composition lacks a pH adjusting agent, including any one or more of the pH adjusting agents disclosed elsewhere herein.

In some embodiments, the fire suppressing and/or extinguishing composition further comprises one or more foaming agents (e.g., an agent or agents that give the composition foaming properties and/or boost the foaming properties of the composition). In some embodiments, the foaming agent comprises one or more of alfalfa extract, *Medicago sativa*, hydroxypropyl methylcellulose (HPMC), methylcellulose, non-ionic water soluble polymers, ionic water soluble polymers, or the like. In some embodiments, the foaming agent has antibacterial and foaming properties. In some embodiments, in addition or instead of being used as a foaming enhancer, HPMC can be used as a non-ionic water soluble polymer that has thickening properties. In some embodiments, the weight percent of the foaming agent or foaming agents in the fire suppressing and/or extinguishing concentrate, individually or collectively, is equal to or at least about: 0.2%, 1%, 5%, 10%, 15%, or ranges including and/or spanning the aforementioned values. In some embodiments, the weight percent of the foaming agent or foaming agents in the fire suppressing and/or extinguishing concentrate, individually or collectively, is equal to or less than about: 0.2%, 1%, 5%, 10%, 15%, or ranges including and/or spanning the aforementioned values. In some embodiments, the weight percent of the foaming agent or foaming agents in the diluted fire suppressing and/or extinguishing concentrate, individually or collectively, is equal to or at least about: 0.02%, 0.1%, 0.5%, 1.0%, 1.5%, or ranges including and/or spanning the aforementioned values. In some embodiments, the weight percent of the foaming agent or foaming agents in the diluted fire suppressing and/or extinguishing concentrate, individually or collectively, is equal to or less than about: 0.02%, 0.1%, 0.5%, 1.0%, 1.5%, or ranges including and/or spanning the aforementioned values. In some embodiments, the fire suppressing and/or extinguishing composition lacks a foaming agent.

While several embodiments described herein comprise a foaming agent, in some embodiments, the fire suppressing and/or extinguishing composition lacks a foaming agent, including any one or more of the foaming agents disclosed elsewhere herein.

In some embodiments, the fire suppressing and/or extinguishing composition further comprises one or more foam stabilizers. In some embodiments, the foaming agent acts as a foam stabilizer. In some embodiments, the weight percent of the foam stabilizer(s) in the concentrated fire suppressing and/or extinguishing composition, individually or collectively, is equal to or at least about: 1%, 5%, 10%, 15%, or ranges including and/or spanning the aforementioned values. In some embodiments, the weight percent of the foam stabilizer(s) in the concentrated fire suppressing and/or extinguishing composition, individually or collectively, is equal to or less than about: 1%, 5%, 10%, 15%, or ranges including and/or spanning the aforementioned values. In some embodiments, the weight percent of the foam stabilizer(s) in the diluted fire suppressing and/or extinguishing concentrate, individually or collectively, is equal to or at least about: 0.1%, 0.5%, 1.0%, 1.5%, or ranges including and/or spanning the aforementioned values. In some embodiments, the weight percent of the foam stabilizer(s) in the diluted fire suppressing and/or extinguishing concentrate, individually or collectively, is equal to or less than about: 0.1%, 0.5%, 1.0%, 1.5%, or ranges including and/or spanning the aforementioned values. In some embodiments, the fire suppressing and/or extinguishing composition lacks a foam stabilizer, including any one or more of the foam stabilizers disclosed herein. In some embodiments, the foam stabilizer comprises one or more of EDTA or sodium gluconate.

In some embodiments, the fire suppressing and/or extinguishing composition further comprises one or more emulsifying agents. In some embodiments, the emulsifying agent comprises one or more of ceteareth 20, non-ionic polyoxyethylene ether of higher saturated fatty alcohols (e.g., cetyl/stearyl alcohol), or the like. In some embodiments, the emulsifying agent is one that dissolves in water and/or alcohol to form a colloid solution. In some embodiments, the emulsifying agent can be mixed with mineral, vegetable or synthetic fats and oils. In some embodiments, the emulsifying agent has an HLB (Hydrophile-Lipophile Balance) value of about 15-17 (gives oil-in-water emulsions). In some embodiments, the weight percent of the emulsifying agent or emulsifying agents in the concentrated fire suppressing and/or extinguishing composition (e.g., the concentrate), individually or collectively, is equal to or at least about: 0.5%, 1%, 5%, 10%, 15%, 30%, or ranges including and/or spanning the aforementioned values. In some embodiments, the weight percent of the emulsifying agent or emulsifying agents in the concentrated fire suppressing and/or extinguishing composition (e.g., the concentrate), individually or collectively, is equal to or less than about: 0.5%, 1%, 5%, 10%, 15%, 30%, or ranges including and/or spanning the aforementioned values. In some embodiments, the weight percent of the emulsifying agent or emulsifying agents in the diluted fire suppressing and/or extinguishing concentrate, individually or collectively, is equal to or at least about: 0.05%, 0.1%, 0.5%, 1.0%, 1.5%, 3.0%, or ranges including and/or spanning the aforementioned values. In some embodiments, the weight percent of the emulsifying agent or emulsifying agents in the diluted fire suppressing and/or extinguishing concentrate, individually or collectively, is equal to or less than about: 0.05%, 0.1%, 0.5%, 1.0%, 1.5%, 3.0%, or ranges including and/or spanning the aforementioned values. In some embodiments, the fire suppressing and/or extinguishing composition lacks an emulsifying agent, including lacking any one or more of the emulsifying agents disclosed herein.

In some embodiments, the fire suppressing and/or extinguishing composition further comprises one or more chelating agents. In some embodiments, the chelating agent comprises one or more of ethylenediaminetetraacetic acid sodium salt (EDTA), sodium gluconate, or the like. In some embodiments, EDTA is used as a chelating agent. In some embodiments, EDTA is used as a co-preservative. In some embodiments, EDTA is used as an emulsifier. In some embodiments, EDTA is used as a foam stabilizer. In some embodiments, the weight percent of the chelating agent or chelating agents in the concentrated fire suppressing and/or extinguishing composition, individually or collectively, is equal to or at least about: 0.1%, 1%, 5%, or ranges including and/or spanning the aforementioned values. In some embodiments, the weight percent of the chelating agent or chelating agents in the concentrated fire suppressing and/or extinguishing composition, individually or collectively, is equal to or less than about: 0.1%, 1%, 5%, or ranges including and/or spanning the aforementioned values. In some embodiments, the weight percent of the chelating agent or chelating agents in the diluted fire suppressing and/or extinguishing concentrate, individually or collectively, is equal to or at least about: 0.01%, 0.1%, 0.5%, or ranges including and/or spanning the aforementioned values. In some embodiments, the weight percent of the chelating agent or chelating agents in the diluted fire suppressing and/or extinguishing concentrate, individually or collectively, is equal to or less than about: 0.01%, 0.1%, 0.5%, or ranges including and/or spanning the aforementioned values. In some embodiments, the fire suppressing and/or extinguishing composition lacks a chelating agent, including lacking any one or more of the chelating agents disclosed herein.

In some embodiments, the fire suppressing and/or extinguishing composition further comprises one or more preservatives. In some embodiments, the preservative comprises one or more of sodium phenoxyethanol, phenoxyethanol, caprylyl glycol, and/or sorbic acid as a preservative. In some embodiments, the weight percent of the preservative or preservatives in the concentrated fire suppressing and/or extinguishing composition (e.g., the concentrate), individually or collectively, is equal to or at least about: 0.5%, 1%, 2%, 4%, 10%, or ranges including and/or spanning the aforementioned values. In some embodiments, the weight percent of the preservative or preservatives in the concentrated fire suppressing and/or extinguishing composition (e.g., the concentrate), individually or collectively, is equal to or less than about: 0.5%, 1%, 2%, 4%, 10%, or ranges including and/or spanning the aforementioned values. In some embodiments, the weight percent of the preservative or preservatives in the diluted fire suppressing and/or extinguishing concentrate, individually or collectively, is equal to or at least about: 0.005%, 0.05%, 0.05%, 0.1%, 0.2%, 0.4%, 1.0%, 1.5%, 2.0%, or ranges including and/or spanning the aforementioned values. In some embodiments, the weight percent of the preservative or preservatives in the diluted fire suppressing and/or extinguishing concentrate, individually or collectively, is equal to or less than about: 0.005%, 0.05%, 0.05%, 0.1%, 0.2%, 0.4%, 1.0%, 1.5%, 2.0%, or ranges including and/or spanning the aforementioned values. In some embodiments, preservatives (e.g., phenoxyethanol) provide effective broad spectrum protection against gram-positive and negative bacteria, yeast and mold while imparting emolliency to the formulation. Caprylyl glycol is a mild humectant that improves efficacy of preservatives. In some embodiments, caprylyl glycol is used with phenoxyethanol at 1-2% weight percent of the concentrated formulation together. In some embodiments, the fire suppressing and/or extinguishing composition lacks a preservative, including lacking any one or more of the preservatives disclosed herein.

In some embodiments, additional extracts are added to the fire suppressing and/or extinguishing composition to improve its compatibility with users (e.g., to further protect or condition the skin of the user, etc.). In some embodiments, the composition comprises bamboo extract, algae extracts (*Laminaria*), Quandong (*Santalum acuminatum*), Desert Lime (*Citris glauca*), wattle seed (*Acacia victoriae*) extract, and/or cactus extract. In some embodiments, the weight percent of the additional extract(s) in the concentrated fire suppressing and/or extinguishing composition (e.g., the concentrate), individually or collectively, is equal to or at least about: 0.5%, 1%, 2%, 5%, 10%, or ranges including and/or spanning the aforementioned values. In some embodiments, the weight percent of the additional extract(s) in the diluted fire suppressing and/or extinguishing concentrate, individually or collectively, is equal to or at least about: 0.05%, 0.1%, 0.2%, 0.5%, 1.0%, or ranges including and/or spanning the aforementioned values. In some embodiments, the fire suppressing and/or extinguishing composition lacks additional extracts.

In some embodiments, psicose is used as an additive. Psicose (allulose, ribo-2-hexulose, $C_6H_{12}O_6$) is a low-energy monosaccharide sugar present in small quantities in natural products. In some embodiments, the weight percent of the psicose in the concentrated fire suppressing and/or extinguishing composition (e.g., the concentrate), individually or collectively, is equal to or at least about: 0.5%, 1%, 2%, 4%, 10%, or ranges including and/or spanning the aforementioned values.

In some embodiments, the concentrate comprises water. In some embodiments, water is added as a diluting agent to the fire suppressing and/or extinguishing composition to prepare the concentrate. In some embodiments, the fire suppressing and/or extinguishing composition (e.g., the concentrate) comprises water at a weight percent equal to or less than about: 10%, 20%, 40%, 50%, 60%, 65% 70%, 75%, 80%, 85%, 90%, 98%, or ranges including and/or spanning the aforementioned values. In some embodiments, the fire suppressing and/or extinguishing composition (e.g., the concentrate) comprises water at a weight percent equal to or at least about: 10%, 20%, 40%, 60%, 70%, 80%, 90%, 98%, or ranges including and/or spanning the aforementioned values.

In some embodiments, the concentrated fire suppressing and/or extinguishing composition (e.g., the concentrate) is diluted with additional water to prepare a dilute composition. In some embodiments, the concentrated fire suppressing and/or extinguishing composition (e.g., the concentrate) is diluted to a weight percent (wt %) of equal to or less than about: 0.25%, 3%, 6%, 10%, 20%, 40%, 60%, 80%, 90%, 98%, or ranges including and/or spanning the aforementioned values. For instance, for a 10 wt % solution of the fire suppressing and/or extinguishing composition can be prepared by diluting 100 g of the concentrated fire suppressing and/or extinguishing composition (e.g., the concentrate) with 900 g of water.

In some embodiments, the concentrated fire suppressing and/or extinguishing composition is diluted with water to a volume percent (vol %) of equal to or less than about: 0.25%, 1%, 3%, 5%, 6%, 9%, 10%, 20%, 40%, 60%, 80%, 90%, 98%, or ranges including and/or spanning the aforementioned values. For instance, for a 10 vol % solution of the fire suppressing and/or extinguishing composition can be prepared by diluting 1 quart of the concentrated fire suppressing and/or extinguishing composition (e.g., the concentrate) with 9 quarts of water.

In some embodiments, the concentrated fire suppressing and/or extinguishing composition is diluted with water to a weight volume (or w/v) of equal to or less than about: 2%, 10%, 20%, 40%, 60%, 80%, 90%, 98%, or ranges including and/or spanning the aforementioned values. For instance, for a 10% w/v solution of the composition can be prepared by diluting 10 g of the concentrated fire suppressing and/or extinguishing composition (e.g., the concentrate) to a volume of 100 mL using water. In some embodiments, the concentrated the fire suppressing and/or extinguishing composition is used without dilution.

For brevity, only certain exemplary wt % values for each possible ingredient in the diluted formulations have been provided above. However, in view of the dilution levels disclosed above, the wt %, vol %, and % w/v value for each particular ingredient in a diluted formulation (from a concentrate as disclosed elsewhere herein) is also envisioned and, therefore, disclosed herein. In other words, it should be appreciated that the total concentration of each ingredient disclosed elsewhere herein can be expressed as a proportion of the concentrated formulation or as a proportion of the diluted formulation. For example, where a concentrate is disclosed as comprising 50 wt % of botanical material, and where a concentrate is disclosed being dilutable to a 10 wt % solution with water, while not expressly written, a diluted formulation comprising botanical material at 5 wt % is also disclosed. The following also illustrates. In some embodiments, 100 g of concentrate can be prepared by adding 50 g of botanical material to 50 g of other ingredients (e.g., a thickening agent, a surfactant, a humectant, an antifreeze agent, a pH adjusting agent, etc.). This concentrate is 50 wt % botanical material. If that concentrate is then diluted with 900 g of water, the wt % of the botanical material is 5 wt % of the dilute formulation. Similarly, where that same 100 g of concentrate is diluted with 1900 g of water, the wt % of the botanical material is 2.5 wt % of the dilute formulation.

Without being bound to any mechanism, it is believed that the fire suppressing and/or extinguishing composition acts, at least in part, as a water delivering agent and/or that evaporative cooling aids in the cooling of the fire. In some embodiments, prior to deploying the composition, it is diluted with water.

As discussed elsewhere herein, some embodiments of the fire suppressing and/or extinguishing composition disclosed herein are non-toxic. In some embodiments, small quantities (e.g., less than about: 5 g, 10 g, 50 g, 100 g) can be ingested safely (e.g., by a human, mammal, or other animal). In some embodiments, the fire suppressing and/or extinguishing compositions disclosed herein can be applied to the skin of humans or other mammals and animals (e.g., dogs, cats, livestock, birds, reptiles, fish, etc.) safely and/or substantially without reaction (e.g., a skin reaction such as a rash or burn). In some embodiments, application of at least about 5 g of the composition to the skin (e.g., by rubbing a person's arm with the composition) leaves no lasting or visible residue on the skin after less than or equal to about: 5 minutes, 15 minutes, 30 minutes, or ranges including and/or spanning the aforementioned values. In some embodiments, application of the composition to the skin causes no visible rash at a time after application of the composition to the skin of less than or equal to about: 5 minutes, 15 minutes, 30 minutes, or ranges including and/or spanning the aforementioned values. In some embodiments, the fire suppressing and/or extinguishing composition is environmentally friendly. In some embodiments, the fire suppressing and/or extinguishing composition is biodegrade and does not substantially harm the environment. In some embodiments, the fire suppressing and/or extinguishing composition is composed primarily or substantially completely of naturally occurring ingredients (e.g., those found in nature).

In some embodiments, the fire suppressing and/or extinguishing composition is halogen-free. In some embodiments, the fire suppressing and/or extinguishing composition lacks compounds having halogen atoms. In some embodiments, the fire suppressing and/or extinguishing composition lacks compounds having a —F, —Cl, —Br, and/or —I. In some embodiments, the fire extinguishing composition is free of sugar alcohols. In some embodiments, the fire suppressing and/or extinguishing composition lacks dulcitol, iditol mannitol, erythritol, threitol, arabitol, ribotol, sorbitol, and/or xylitol. In some embodiments, the fire suppressing and/or extinguishing composition lacks and/or is free of halogen containing ingredients. In some embodiments, the fire suppressing and/or extinguishing composition lacks and/or is free of sugar alcohols.

In some embodiments, the fire suppressing and/or extinguishing composition has a heat capacity that is higher than the heat capacity of water (e.g., 4.184 Joules/g·K). In some embodiments, the heat capacity of the fire suppressing and/or extinguishing composition is at least about: 5 Joules/g·K, 8 Joules/g·K, 11 Joules/g·K, 14 Joules/g·K, or ranges including and/or spanning the aforementioned values.

In some embodiments, the fire suppressing and/or extinguishing composition has a rapid cooling effect, lowering the temperature of the burning material below its flash point. In some embodiments, the fire suppressing and/or extinguishing composition also rapidly cools the material that was burning after the fire is extinguished. In some embodiments, the temperature of the material after fire has been put out is decreased to a temperature at or below room temperature (about 73° F.). In some embodiments, application of the fire suppressing and/or extinguishing composition extinguishes fire fueled by a flaming object and simultaneously, substantially simultaneously, cools the object after the fire is extinguished to a temperature below about: 300° F., 200° F., 100° F., 72° F., or ranges including and/or spanning the aforementioned values. In some embodiments, the temperature decreases substantially immediately upon the fire being extinguished. In some embodiments, the temperature of the object is decreased to below about 100° F. within a time after the fire is extinguished of about: 1 s, 5 s, 10 s, 30 s, or ranges including and/or spanning the aforementioned values. In some embodiments, the temperature of the extinguished material (e.g., magnesium metal) decreases to below room temperature (about 72° F.) at a time after the fire is extinguished of about: 1 s, 5 s, 10 s, 30 s, or ranges including and/or spanning the aforementioned values.

Some embodiments pertain to methods of preparing a fire suppressing and/or extinguishing composition. In some embodiments, a temperature suppressing agent and/or a water delivery agent is mixed with stirring. In some embodiments, where the temperature suppressing agent and/or a water delivery agent is in powder form, it is mixed in a sufficient quantity of water, as described elsewhere herein, to dissolve the powder or suspend the powder. In some embodiments, a thickening agent is added while mixing. In some embodiments, a surfactant added while mixing. In some embodiments, a humectant is added while mixing. In some embodiments, an agent that prevents the crystallization of water (e.g., an antifreeze agent) is added while mixing. In some embodiments, a pH adjusting agent is added while mixing. In some embodiments, the composition is diluted with water, as described elsewhere herein.

In some embodiments, the formulation is placed in a canister (e.g., a fire extinguisher) for deployment as a concentrate or diluted formulation. In some embodiments, the container (e.g., canister) is pressurized using a compressed gas (e.g., air, $CO_2$, $N_2$, etc.). In some embodiments, the composition deploys as a mist, spray, liquid, gel, or aerogel. In some embodiments, the fire suppressing and/or extinguishing composition is placed within a fire extinguisher canister. In some embodiments, a vessel comprising the composition can be pressurized using compressed air. In some embodiments, the canister is pressurized to a pressure of equal to or at least about: 80 psi, 100 psi, 120 psi, 150 psi, or ranges including and/or spanning the aforementioned values. For example, in some embodiments, using a 2.5 gallon extinguisher about 1 quart of fire suppressing and/or extinguishing composition is added. In some embodiments, about 9 quarts of water (e.g., tap water, distilled water, and/or deionized water) is then added. In some embodiments, the dilute composition is prepared and then added to the canister. In some embodiments, the dilution is performed in the canister. In some embodiments, the fire extinguisher is then sealed and pressurized to about 120 psi using, for example, a compressor.

In some embodiments, the concentrate can be distributed as a foam using a proportioner (e.g., FoamPro or similar proportioners). Proportioners can be attached to fire hoses and/or fire extinguishers to distribute a concentrate into a flowing liquid stream (e.g., water), diluting the concentrate to a desired level. In some embodiments, the proportioner dilutes the composition concentrate by a vol %. In some embodiments, the proportioner dilutes the concentrated fire suppressing and/or extinguishing composition to a volume percent (vol %) of equal to or less than about: 0.25%, 1%, 3%, 5%, 6%, 9%, 10%, 20%, 40%, 60%, 80%, 90%, 98%, or ranges including and/or spanning the aforementioned values. In some embodiments, the formulation is miscible with water. In some embodiments, the composition stays miscible in water when deployed by a proportioner into a stream of water. In some embodiments, the polymeric components of the composition are mutually miscible. In some embodiments, the polymeric components of the composition remain mutually miscible when deployed by a proportioner.

In some embodiments, the proportioner discharges the concentrate into at the discharge side of the nozzle. By injecting into the discharge side, proportioning performance is not affected by external factors such as nozzle, length of hose lay, nozzle elevation or incoming pressure to the water pump. In some embodiments, the proportioning system automatically reads water flow and injects concentrate: from 0.1% to 10.0%.

In some embodiments, a polymeric temperature suppressing agent and/or water delivery agent (e.g., botanical material) and polymeric thickening agent (e.g., polysaccharide)

are mutually miscible. Mutual miscibility beneficially provides an extinguishing agent that is distributed uniformly and reproducibly when used. In some embodiments, the temperature suppressing agent and/or water delivery agent (e.g., botanical material) and the thickening agent (e.g., polysaccharide) are mutually miscible in the composition at a concentration of at least about 0.5% and at least about 0.5%, respectively. In some embodiments, the temperature suppressing agent and/or water delivery agent and the thickening agent are mutually miscible in the composition at a concentration of at least about 0.25% and at least about 0.25%, respectively. In some embodiments, the temperature suppressing agent and/or water delivery agent and the thickening agent are mutually miscible in the composition at a concentration of at least about 0.1% and at least about 0.1%, respectively.

Some embodiments pertain to methods of suppressing and/or extinguishing fires. In some embodiments, the method involves contacting a fire fuel source (e.g., a Class A, B, C, D, K fire source) with a fire suppressing and/or extinguishing composition as described elsewhere herein. In some embodiments, the method for suppressing and/or extinguishing the fire includes a step of applying a fire suppressing and/or extinguishing composition to an object or person at risk of catching fire (e.g., prior to exposure to fire) or that is on fire (e.g., to extinguish the fire). For example, in some embodiments, the composition can be applied to skin, the clothing (e.g., the uniform of a fire fighter, military personnel, police, etc.), fabrics (e.g., burlap, cotton cloth, synthetic fabrics, etc.), fur, a vehicle (e.g., tires, exterior surfaces, interior surfaces, etc.), buildings (e.g., a roof, exterior surfaces, interior surfaces, etc.), or raw materials for fabricating any of the foregoing (e.g., magnesium wheel frames, wood piles, textiles, cloth, etc.), wherein the composition is applied prior to exposure to an ignition source or fire, or while the burning article is on fire.

For example, in some embodiments, the compositions disclosed herein (concentrated or diluted) can be applied to textiles that are used as building materials. In some embodiments, the compositions disclosed herein (concentrated or diluted) can be used to coat (e.g., can be applied to) structures, including homes, armories, storage facilities (e.g., for ordinances), or the like to prevent burning.

In some embodiments, the compositions disclosed herein (concentrated or diluted) can be used as an additive. In some embodiments, the compositions disclosed herein can be added to paints to provide a flame retardant or suppressive paint. In some embodiments, these paints can be used for vehicles, houses, etc., to provide fire suppressive protection.

In some embodiments, the fire suppressing and/or extinguishing composition is effective in extinguishing or suppressing fire events and, in particular, extinguishing or suppressing fire events likely to be encountered during military operations. In some embodiments, the fire suppressing and/or extinguishing composition is effective for use across fire classes. In some embodiments, the fire suppressing and/or extinguishing composition is organic-halide free (e.g., fluorocarbon-free and/or halon-free). In some embodiments, the fire suppressing and/or extinguishing composition is sugar alcohol free. In some embodiments, the fire suppressing and/or extinguishing composition is composed of natural-products and/or is safe to the environment and to mammals and/or animals (e.g., humans, dogs, cats, livestock, birds, reptiles, fish, etc.). In some embodiments, the fire suppressing and/or extinguishing composition is safe to deploy around or on humans. In some embodiments, upon being deployed, the fire suppressing and/or extinguishing composition can be inhaled without damage and/or without substantial damage to the lungs. In some embodiments, the fire suppressing and/or extinguishing composition deploys without requiring the explosive forces typical of those used to deploy fluorocarbon- and halon-based compositions. In some embodiments, the fire suppressing and/or extinguishing composition is safe to ingest. In some embodiments, the fire suppressing and/or extinguishing composition remains in an aqueous state as it is being deployed from its storage means in response to a fire event. In some embodiments, the fire suppressing and/or extinguishing composition does not produce any acid gases when exposed to the high heat and temperatures associated with fire events.

In some embodiments, the fire suppressing and/or extinguishing composition instantaneously or substantially instantaneously deploys from a storage means (e.g., a container) typically used in fire suppression systems—including but not limited to fire extinguishers, extinguisher backpacks, holding tanks, and building and vehicle fire suppression piping systems—without the need for the high forces required by fluorocarbon and halon-based compositions. In some embodiments, the fire suppressing and/or extinguishing composition can be stored for relatively long periods of time and in a wide range of temperature conditions yet retain its fire suppression characteristics and remain in a immediately deployable state.

Any portion of any of the steps, processes, structures, and/or devices disclosed or illustrated in one embodiment, flowchart, or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and other implementations of the disclosed features are within the scope of this disclosure. For the methods disclosed herein, the functions performed in the processes and methods may be implemented in differing order. The disclosure of methods or uses may also include instructing the method or use (for example, in instructions for use).

In addition, where features or aspects of the disclosure are described in terms of Markush groups, those skilled in the art will recognize that the disclosure is also thereby described in terms of any individual member or subgroup of members of the Markush group.

With respect to the use of substantially any plural and/or singular terms herein, those having skill in the art can translate from the plural to the singular and/or from the singular to the plural as is appropriate to the context and/or application.

It will be understood by those within the art that, in general, terms used herein, and especially in the appended claims (for example, bodies of the appended claims) are generally intended as "open" terms (for example, the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (for example, "a" and/or "an" should be interpreted to mean "at least one" or "one or more"); the same holds true for the use of definite articles used to introduce claim recitations. For example, "an" agent can include one, two or several ingredients (and not necessarily a single ingredient). In addition, even if a specific number of an introduced claim recitation is explicitly recited, those skilled in the art will recognize that such recitation should be interpreted to mean at least the recited number (for example, the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (for example, "a system having at least one of A, B, and C" would include but not be limited to systems that have A alone, B alone, C alone, A and B together, A and C together, B and C together, and/or A, B, and C together, etc.). It will be further understood by those within the art that any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into sub-ranges as discussed above. Finally, as will be understood by one skilled in the art, a range includes each individual member. Thus, for example, a group having 1-3 articles refers to groups having 1, 2, or 3 articles. Similarly, a group having 1-5 articles refers to groups having 1, 2, 3, 4, or 5 articles, and so forth. The phrases "and ranges in between" can include ranges that fall in between the numerical values listed. For example, "1, 2, 3, 10, and ranges in between" can include 1-10, 1-3, 2-10, etc. Similarly, "1, 5, 10, 25, 50, 70, 95, or ranges including and/or spanning the aforementioned values" can include 1, 5, 10, 1-5, 1-10, 10-25, 10-95, 1-70, etc.

EXAMPLES

Example 1

A fire suppressing and/or extinguishing composition ("E1.1 Composition") was prepared by mixing the following ingredients: 34 oz. Aloe Vera gel (store bought from aloefarmtexas); 6.4 oz. coco betaine, 0.17 oz. propylene glycol. The process comprises adding the 34 oz of aloe vera to a 10 qt. commercial mixing bowl and stirring with a commercial mixer (e.g., a KitchenAid mixer). Then, the 0.17 oz. of propylene glycol was added to the mixture with mixing for 2 minutes on low speed. Thereafter, the 6.4 oz. of coco betaine was added to the mixture with mixing for an additional minute at the lowest speed (to prevent foaming) to generate the composition (i.e. extinguishing agent). A second formulation ("E1.2 Composition") was made using the same procedures and ingredients above but by also adding 2 oz. of glycerin.

The fire extinguishing capabilities of the above compositions were tested on Class A, B, C, D, and K fires. Briefly, in each case, a 2.5 gallon fire extinguisher was loaded with a quart of the extinguishing agent (either the E1.1 Composition or the E1.2 Composition) and 9 quarts of tap water. In each case, the canister was then pressurized with an air compressor to about 120 psi. The fire extinguisher was a smooth bore nozzle, however, any style nozzle can be used with the similar and/or the same results.

For the Class A fire testing, a regular sized camp fire was made using 2 wood pallets broken down into pieces. The fire was set using paper and a torch. Once the wood was totally engulfed in flames, the E1.1 Composition or the E1.2 Composition was sprayed at about a 45° angle from about 4 feet away from the fire. Approximately ⅓ of the canister (about 106 oz.) of fluid was used in each test. The E1.1 Composition and E1.2 Composition each extinguished the Class A fire in about 5 seconds.

For a Class B fire test, 2 quarts of fuel (gasoline) was used. For each test the fuel was set on fire with a torch and allowed to burn for a few minutes until reaching a temperature of about 1500° F. The fire was then sprayed with a fire extinguisher (as prepared above) at about a 45° angle from about 5 feet away. The E1.1 Composition and E1.2 Composition each extinguished the Class B fire in about 5 seconds. Thereafter, another quart of the E1.1 Composition or the E1.2 Composition was sprayed onto the fuel. Using the ignition source (e.g., the torch), attempts were made to reignite the fuel, but the fuel could not be reignited with either composition. After about 10 seconds, the temperature of the fuel dropped to about 51° F. for each of the E1.1 Composition and the E1.2 Composition. It was noted that the fuel was cool to the touch (via the sides of the metal barrel containing the fuel).

For a second type of Class B fire test, 2 quarts of ethanol was ignited in a metal barrel with a torch and let burn for a few minutes until a temperature of about 2000° F. was reached (the upper temperature of the fire was limited by the range of the heat detector used; the temperature was more likely 3400° F.). The fire was then sprayed with a fire extinguisher of the E1.1 Composition or the E1.2 Composition at an angle of about 45° and at about 5 feet away. The fire extinguished in about 5 seconds and the final temperature after about 10 seconds was about 49° F. for each of the E1.1 Composition and the E1.2 Composition.

For a Class D fire test, a 500 g pile of magnesium shaving was ignited with a torch. The fire was then sprayed with one of the fire extinguishing solutions at about a 45° angle from about 5 feet away. The fire extinguished in about 7 seconds using less than a quart of the E1.1 Composition or the E1.2 Composition.

For a second test on a Class D fire, a 500 g magnesium block was ignited and let burn for a few seconds until it was engulfed by fire. The fire was then sprayed with a fire extinguishing solution at about a 45° angle from about 5 feet away. The fire formed a crust on top of the block. The E1.1 Composition and E1.2 Composition each extinguished the fire on the block in about 5 seconds before penetrating the crust and extinguishing the metal under the crust in about 7 additional seconds. About 2 quarts of each of the E1.1 Composition and the E1.2 Composition was used in each test and the extinguished block was cool to the touch (it could be picked up) after about 10 seconds. In each case, the temperature dropped from an estimated 3100° F. to about 56° F.

For class K fire, about 1 quart of cooking oil was set on fire with a torch and let burn until the temperature reached about 1000° F. The fire was then sprayed with either the E1.1 Composition or the E1.2 Composition at about a 45° angle from about 6 feet away. For each of the E1.1 Composition and the E1.2 Composition, the fire extinguished in about 4 seconds using about 16 ounces of the E1.1 Composition or the E1.2 Composition and could not be reignited. The temperature reduced to about 85° F. in less than 10 s in each case.

For a second test, 250 g of lard was ignited and allowed to burn until reaching a temperature above 1000° F. The fire was then sprayed with a fire extinguishing solution at about a 45° angle from about 6 feet away. For each of the E1.1 Composition and the E1.2 Composition, the fire extinguished in about 6 seconds using about 16 ounces of the formulation and could not be reignited. The temperature of the lard dropped to about 184° F. after 15 seconds in each case.

Table 1 below summarizes the results of the testing for each of the E1.1 Composition and the E1.2 Composition.

TABLE 1

| Fire Class | Fuel Source | Time to Extinguish |
|---|---|---|
| Class A | Wood planks | 5 s |
| Class B | Gasoline (2 quarts) | 5 s |
| Class B | Ethanol (2 quarts) | 5 s |
| Class D | Magnesium shavings (500 g) | 7 s |
| Class D | Magnesium block (500 g) | 11 s |
| Class K | Cooking oil (1 quart) | 4 s |
| Class K | Lard (250 g) | 6 s |

This test demonstrates the ability of the above compositions to extinguish multiple fire Class types in short periods of time.

Example 2

Several fire extinguishing formulations were prepared using similar procedures to those described in Example 1. Briefly, 60 oz of aloe vera juice (aloe farm) was placed in the mixer. Then, 0.3 oz of xantham gum was sprinkled in to the aloe vera and allowed to hydrate for a few minutes. The mixture was then mixed at medium speed until the preparation thickened and the xantham gum was well dissolved (about 5 minutes). Thereafter, 4.8 oz. of 1,3-propane diol was added along with 12 oz. of cocobetaine and 0.42 oz of triethanolamine. The formulation was mixed on the lowest speed for about 2 minutes. The low mixing rate aided in avoiding foaming. As shown in Table 2, the compositions contained different concentrations of ingredients.

The specific heat capacity of each of these formulations was then calculated using the following formula:

$$s = \frac{q}{m \times \Delta T}$$

Where s is the specific heat capacity, q is the heat, m is the mass, and ΔT is the change in temperature.

To test the heat capacity, 200 g of each formulation was placed in an insulated container to reduce heat transfer to the environment (e.g., by evaporation). The formulation was heated using a power supply and a 5×10 ohm capacitor (the resistor was placed into the cup so that the resistor was submerged). About 7 volts was delivered using the triple linear DC power supply (0-30V at 5 amps). With a temperature probe and a timer, temperature changes were noted every 2 minutes, until the temperature was at least about 5 degrees over the initial temperature (e.g., at least 6 to 7 degrees difference from the initial temperature (i.e. ambient temperature)). The specific heat capacity of each formulation is also shown in Table 2.

TABLE 2

| Sample | Ingredients | Specific Heat Capacity |
|---|---|---|
| Water (Control) | N/R | 4.18 |
| *Aloe* Juice | *Aloe* juice from Aloe Farm. | 2.92 |
| Formulation 1: | *Aloe* juice 60 oz<br>Xanthan gum 0.3 oz<br>Cocobetaine 12 oz<br>Propanediol 4.8 oz<br>Triethanolamine 0.42 oz | 11.89 |
| Formulation 2: | *Aloe vera* (aloefarm) 8 oz<br>Carbomer 1.25 oz.<br>Cocobetaine 1.5 oz<br>Propanediol (1,3) 0.2 oz<br>Triethanolamine 20 drops | 6.27 |
| Formulation 3: | *Aloe Vera* (aloefarm) 34 oz<br>Guargum 0.2 oz.<br>Cocobetaine 6.4 oz<br>Propanediol (1,3) 1.6 oz<br>Triethanolamine 0.21 oz | 8.84 |
| Formulation 4: | Water 60 oz<br>Bialoe (powder) 0.102 oz<br>Xantham 0.3 oz.<br>Cocobetaine 12 oz<br>Propanediol 4.8<br>Triethanolamine 0.42 | 13.69 |
| Formulation 5: | Water 60 oz<br>*Aloe* powder 1:100 0.5 oz<br>Hydrolxypropyl methylcellulose 0.3 oz<br>Cocobetaine 12 oz<br>Propanediol 4.8 oz<br>pH adjusted to between 6.5 and 7.0 by adding TEA | 6.72 |

Prior to testing Formulation 1 from above, 1 quart of the formulation was mixed with 9 quarts of tap water (a 10% by volume solution). The extinguisher was loaded with the formulation and pressurized at 120 psi using an air compressor. The extinguishing ability of Formulation 1 was then tested on a Class D fire. A 500 g solid piece of magnesium (not shavings) was ignited using a torch. The extinguishing formulation was sprayed on the magnesium block at about 45° angle using a smooth bore nozzle, first with a light pressure to extinguish the first layer on fire (on top of the crust created by the magnesium block burning) for about 5 seconds and then with a stronger pressure spray to penetrate the crust and extinguish the fire underneath the crust for another 10 seconds before complete extinction (e.g., with no or very little reaction). The extinguished magnesium could be picked up within the next 10 seconds of extinguishing.

The Aloe juice cooled the magnesium enough to put the fire out, but the second embodiment (Aloe+xantham gum) worked much faster.

It was concluded that Formulation 1 the aloe and thickening agent (aloe and xantham which forms the gel) worked synergistically to cool the magnesium block. The magnesium was instantly cool to the touch (testing by picking up the piece of magnesium with hands). The magnesium was also still a solid piece.

Ethanol (a Class B fire agent) was then tested. Briefly, 2 quarts of ethanol was placed in a metal container and lit on fire with a torch. The fire was allowed to burn until reaching over 2000° F. At about a 45° angle, the formulation was then sprayed at the base of the fire. The formulation extinguished the fire in less than 3 seconds with a temperature dropping from over 2000° F. to about 49° F. in less than 10 seconds. It was noted that the oil on the top of the solution was encapsulated. No matter how much it was attempted, the ethanol would not reignite and it could be touched with bare hands (bare fingers could be submerged in the ethanol). Ethanol is very hard to extinguish due to its high volatility (showing the high efficacy of this formulation).

Upon discharge from the extinguisher, the compound produced stable foam with a very slow drainage. Without being bound to a mechanism, it is believed that the foam blankets the fuel surface smothering the fire, separating the flames and ignition source from the fuel surface by encapsulation. It is also believed that the formulation cools the fuel and suppresses the release of flammable vapors that can mix with the air. It was noted that Formulation 1 had high thermal resistance, with a very good viscosity. It was noted that competitor products showed breakage and very poor stability of foam, yet the bubbles created with the disclosed formulation were very strong and the foam had a very slow drainage. The formulation had no slippery feeling and provided a good seal against fuel vapors.

Xanthan gum was selected as a polymeric material because of its ability as a polysaccharide to be water soluble and swellable. The xanthan gum aids in causing the foam to form a gelatin when it comes in contact with a polar hydrophilic liquid (alcohols, ketones, etc.). Therefore, it acts as a barrier towards the fuel vapors and liquids and prevents the foam blanket from breaking.

Example 3

In the following experiments, different ingredients were tested. Some embodiments of the composition comprise a temperature suppressing agent and/or a water delivery agent. In some embodiments, the temperature suppressing agent and/or a water delivery agent is aloe vera. Several tests were performed with different Aloe Vera juice suppliers (e.g., Aloe Vera gel, Aloefarm aloe Vera gel, Bialoe (powder from aloe barbadensis Miller inner leaf gel) from Loraland laboratories, bioactive aloe powder from aloecorp, Naturmanan aloe powder from Naturaloe Costa Rica).

One of the main components of aloe vera are polysaccharides. For that reason, one polysaccharide of aloe vera was selected for testing as a temperature suppressing agent and/or a water delivery agent: acemannan. It was found that, in some embodiments, acemannan could be used in addition to, or instead of aloe vera. In a commercial mixer, 8 oz of water was added followed by 0.028 oz of BIALOE® powder. This viscous liquid was mixed on medium speed for a few minutes. To the liquid was added 0.08 oz of hyaluronic acid (HA) which was allowed to hydrate for a minute and then was mixed on medium speed until total dissolution and thickening occurred. Thereafter, 0.04 oz of xantham gum was added and mixed on medium speed until total dilution and thickening was observed. Then, 0.32 oz propanediol (1,3) and 0.35 oz of cocobetaine was added and the liquid was mixed on slow for less than a minute (to avoid foaming).

To test the formulation, it was applied to a piece of pine wood (quarter inch piece of untreated pine quarter inch thick 8 inches long). The formulation was applied in a layer about 3 mm thick on half of the piece of wood. Then, a MAPP gas torch (which burns at 3670° F.) was ignited and the flame of the torch was moved in a back-and-forth motion over the treated wood placed at about a 45° angle. The untreated part immediately discolored and ignited within 15 seconds. The gelled part stayed stable for over a minute and then starts to lift up over the wood to create a thermal barrier. The gel started to discolor a little bit after a couple minutes but the wood was not touched. The gel was wiped clean from the wood immediately and the wood remained intact and cool to touch.

A competitor product (Commercial Formulation 1) was tested in the same manner and the test specimen ignited within about 10 seconds (indicating the extinguishing agent itself was flammable under the tested conditions).

In some embodiments, as stated above, it is advantageous to select aloe vera types that retain more water because they are able to cool more types of fire to the point of non-reignition.

Some embodiments were prepared using hyaluronic acid (HA). HA is a large polysaccharide that occurs in various tissues (skin, synovial fluid of joints, connective tissues) and is responsible for tissue hydration and lubrication. The HA used had a molecular weight of 800 to 1200 kDa.

In some testing, it was determined that 1,3 propanediol had emollient, humectant, preservative booster properties. It is also 100% safe and biodegradable. Thus, in some embodiments, 1,3 propanediol was selected for use in the fire extinguishing composition.

In some testing, it was determined a carbomer could be used as a thickener. Xanthan gum (which is another polysaccharide) was also used as a thickener. It showed good performance in extinguishing fuel fires and was fully biodegradable.

Example 4

Several experiments were performed using a formulation comprising BiAloe powder. To prepare the aloe powder formulation, 60 oz of distilled water was placed in a mixing bowl and 0.228 oz of BiAloe powder were sprinkled in it with slow mixing until total dissolution. Then, 0.3 oz of xanthan gum (prehydrated for easy mixing) was sprinkled into the solution. The mixture was slowly mixed for about 10 minutes until thickening. Then, 12 oz of cocobetaine was added and mixed. Then, 4.8 oz of propanediol 1,3 was added and mixed. Then 0.42 oz of Triethanolamine was added and mixed (to adjust pH to 7). The formulation (equivalent to "Formulation 1" from Table 2) is then ready to use as a 10% by volume dilution in tap water.

The extinguishing agent was placed in a fire extinguisher and pressurized (as described elsewhere herein). As shown in Table 3 below, several different fire types were tested against the formulation (using the same general procedures described in Example 1).

TABLE 3

| Material | Initial Temperature | Time to Extinguish | Temperature After Extinguish |
|---|---|---|---|
| 500 g Mg Block | 3100° F. | 5 s | 56° F. |
| 2 qt. Fuel (gas oil) | 495° F. | 3 s | 51° F. |

TABLE 3-continued

| Material | Initial Temperature | Time to Extinguish | Temperature After Extinguish |
|---|---|---|---|
| 2 qt. Ethanol | 695° F. | 3 s | 49° F. |
| 2 qt. Acetone | 895° F. | 4 s | 62° F. |
| 2 wood logs | 575° F. | 2 s | 52° F. |
| 500 g charcoal | 678° F. | 2 s | 51° F. |

As shown above, each fire was extinguished in a matter of seconds using the tested composition. The previously burning material also rapidly cooled to below room temperature after the fire was extinguished.

Example 5

The fire extinguishing capabilities of the several commercially available compositions (listed in Table 4 shown in FIG. 1) were tested on Class A, B, C, D, and K fires against a test formulation as described above. Briefly, for each extinguishing composition, a 2.5 Buckeye gallon fire extinguisher was loaded with the extinguishing agent according to manufacturer specifications. The mix ratios of the commercial compositions included 3-6 and 10% volumes diluted in water (as shown in Table 4). The test embodiment (labeled "EFS" in Table 4) was prepared as described in Example 4. Each canister was then pressurized with an air compressor to about 120 psi. The fire extinguisher used in each test was a smooth bore nozzle. The testing was performed outside at a temperature of about 82 degrees Fahrenheit with a relative humidity of 20% and calm winds.

For Class A fires, three different materials were set on fire and used to test each formulation: wood, paper, and a car tire. For example, a fire using 2 wood pallets broken down into pieces was used for the wood fire. The fire was set using paper and a torch. Once the wood was totally engulfed in flames, a fire extinguishing composition was sprayed from the extinguisher at the burning material at a 45° angle from about 5 feet away. Table 4 shows the results of the test for each composition.

For Class B fires, the following materials were each separately set on fire and used to test each formulation separately: oil, gas, diesel, jet fuel, hydraulic oil, ethanol, acetone, and brake kleen. For example, 2 quarts of oil in a metal container was set on fire using a torch. After about 30 seconds, the oil was totally engulfed in flames. At that time, a fire extinguishing composition was sprayed from the extinguisher at the burning material at a 45° angle from about 5 feet away. The results were noted. Table 4 shows the results of the test for each composition.

For Class C fires, an electrical fire was started and used to test each formulation separately. Briefly, the fire was started using a 400 amp breaker and a 200' length of balled 6 gauge wire. The wire was shorted, igniting it. At that time, a fire extinguishing composition was sprayed from the extinguisher at the burning material at a 45° angle from about 5 feet away. Table 4 shows the results of the test for each composition.

For Class D fires, 18 ounce blocks of magnesium were ignited using a torch. Once the block was completely engulfed in flames, a fire extinguishing composition was sprayed from the extinguisher at the burning material at a 45° angle from about 5 feet away. As shown in Table 4, only the EFS test solution was able to extinguish the Class D fire.

Figure 2B:
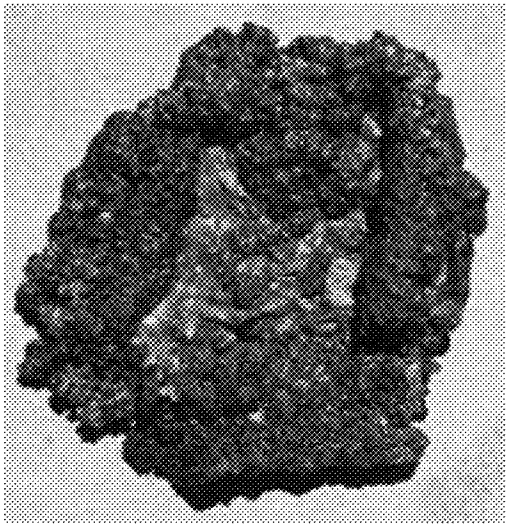
Figure 2A:
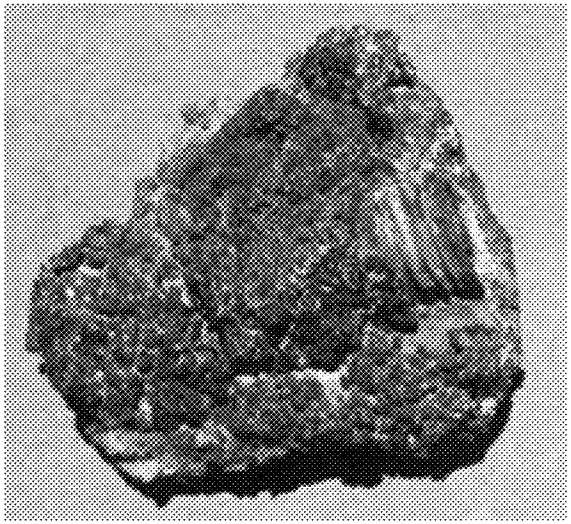

For the Class D fire, a 10% dilution of the EFS composition effectively extinguished the block of magnesium in 10 seconds with massive cooling allowing the block to be picked-up immediately after it was extinguished. The only observation of damage to the magnesium block was the separation of a crust from the main block. Other than that, there was no explosive reaction during extinguishing of the magnesium. The material after extinguishing was a silver-colored disc (see FIG. 2A) that was very reactive to water. The disc was readily reignited when water was placed on it. It was concluded that EFS put the magnesium fire out initially and left the magnesium intact and unreacted. The unreacted magnesium was readily reignited with water thereafter demonstrating that magnesium remained intact as a fuel source.

The Commercial Formulation 12 manufacturers claim that the composition is suitable for Class A, B, and D fires. The testing performed herein demonstrated that this formulation works only on Class A and B fires. While using this formulation on Class D fires, it was noted that the composition had no effect on putting out the magnesium fire when a block weighing 10 ounces was used. Commercial Formulation 12 composition sat on top of the magnesium as the magnesium continued to burn. It was noted that the composition did not have an ill effect (as far as a causing a reaction like water does—which causes a large hot burning fire). Burning the magnesium and trying to suppress it with Commercial Formulation 12 left behind a coal type pile that was hard to the touch (see FIG. 2B). When the magnesium was subjected to reigniting conditions with water, it would not burn. Thus, it was concluded that the magnesium was exhausted leaving nothing behind to react with water. It is also noted that Commercial Formulation 12 is not listed with UL.

For Commercial Formulation 13, the manufacturers claim that it is suitable for Class D fires though it is UL listed for Classes A and B only. During the Class D test procedures described above, a 3% mix of Commercial Formulation 13 was used suggested by the manufacturers. During attempted extinguishing, a large explosive reaction (like spraying pure water on magnesium) occurred. To rule out a concentration as the result of this reaction, the dilution was increased to 10%, but the formulation yielded the same results. Burning the magnesium and trying to suppress it with Commercial Formulation 13 left behind a coal type pile that was hard to the touch (see FIG. 2C). When the magnesium was subjected to reigniting conditions with water, it would not burn. Thus, it was concluded that the magnesium was exhausted leaving nothing behind to react with water.

Class K fire was tested using animal lard on the first test and vegetable oil on the second test. Both were heated up to their flash point and allowed to burn for two minutes before the use of EFS, thus allowing for full ignition of the oils and fats with temps of about 1100° F. The test results are shown in Table 4. For the EFS solution, both materials were extinguished with minimal product volume in less than 8 seconds with a rapid cooling effect that took the temperature from 1100 to 64° F. at the end of the eight seconds. There was no danger of reigniting due to the rapid cooling effect.

For a stability test, the compositions were placed on a wood board. The treated wood was then heated using a torch for 15 seconds. The 15 second burn test with super heat at 3623° F. (as shown in Table 4), demonstrated that EFS does not burn-off or boil away and protects the wood from burning. The EFS compound has a MSDS of 0-0-0 and is aquatic life friendly. Unlike the EFS composition, during the 15 second burn test using super heat, a competitor product (Commercial Formulation 13) composition boils-off and allowed burning of the wood on which it was placed. The 15 second burn test with super heat, using Commercial Formulation 12 demonstrated that the composition boils-off and allowed burning of the wood on which it was placed.

The Mix Reaction data was gathered by mixing each of the commercial formulations with the EFS formulation. A mix reaction (gelation) was only noted with Commercial Formulation 1.

Example 6

Several experiments were performed using a formulation comprising BIALOE® powder. To prepare the formulation, 93.16 oz of deionized ("DI") water was combined with 0.315 oz of BIALOE® powder. BIALOE® powder was sprinkled into the water with slow mixing in the mixing bowl until total dissolution to create a reconstituted BiAloe solution. Then in a different container, 0.41 oz of xanthan gum was mixed with 16.44 oz. of 1,3 propane diol. The reconstituted BiAloe solution and the xanthan gum/1,3-propane diol mixture was then combined and stirred. The combination was slowly mixed for about 10 minutes until thickening. Thereafter, 16.44 oz of cocobetaine and 1.23 oz of phenoxyethanol was added and mixed. Then triethanolamine was added to adjust the pH of the formulation to about pH 6.5. It was noted that premixing the gum and propanediol advantageously led to less bubble formation in the composition during mixing. The resulting formulation (hereinafter the "E6 Concentrate") was then ready to use as an extinguishing agent as a concentrate or as a diluted solution. Table 5 shows the proportions of ingredients in tabular form.

TABLE 5

| Sample | Ingredients | Wt % |
|---|---|---|
| E6 Concentrate | Full Concentration | — |
| | Deionized water 93.16 oz | 72.8 |
| | Bialoe 0.315 oz | 0.246 |
| | Xantham 0.41 oz | 0.320 |
| | Cocobetaine 16.44 oz | 12.8 |
| | 1,3 Propanediol 16.44 oz | 12.8 |
| | Phenoxyethanol 1.23 oz | 0.961 |
| | pH adjusted to 6.5 by adding TEA | ~ |

For the purposes of the following testing, dilute solutions were prepared using the E6 Concentrate. The density of the E6 Concentrate was determined to be about 8.8 pounds per gallon (with a specific gravity of 1.04). The density of water is 8.345 pounds per gallon. The E6 Concentrate was diluted to a 6 vol % solution by adding 9.4 quarts of deionized water to 0.6 quarts of E6 Concentrate. The 6 vol % solution (hereinafter E6 ExptSamp 1) was set aside for later testing. To prepare and additional test solution, the E6 Concentrate was diluted to a 0.25 vol % solution by adding 9.975 quarts of water to 0.025 quarts of E6 Concentrate. The 0.25 vol % solution (hereinafter E6 ExptSamp 2) was set aside for later testing. Table 6 shows the proportions of ingredients in tabular form.

TABLE 6

| | | |
|---|---|---|
| E6 ExptSamp 1 | 6% by volume dilution | 6.3 wt % |
| | Deionized water 93.16 oz | 4.59 wt % |
| | Bialoe 0.315 oz | 0.0155 wt % |
| | Xantham 0.41 oz | 0.0202 wt % |
| | Cocobetaine 16.44 oz | 0.806 wt % |
| | 1,3 Propanediol 16.44 oz | 0.806 wt % |
| | Phenoxyethanol 1.23 oz | 0.0605 wt % |
| | pH adjusted to 6.5 by adding TEA | ~ |

TABLE 6-continued

| | | |
|---|---|---|
| E6 ExptSamp 2 | 0.25% by volume dilution | 0.263 wt % |
| | Deionized water 93.16 oz | 0.191 wt % |
| | Bialoe 0.315 oz | 0.000647 wt % |
| | Xantham 0.41 oz | 0.000842 wt % |
| | Cocobetaine 16.44 oz | 0.0337 wt % |
| | 1,3 Propanediol 16.44 oz | 0.0337 wt % |
| | Phenoxyethanol 1.23 oz | 0.00252 wt % |
| | pH adjusted to 6.5 by adding TEA | ~ |

The fire extinguishing capabilities of E6 ExptSamp 1 and E6 ExptSamp 2 was tested on Class A fires, Class B fires, Class C fires, Class D fires, and Class K fires. Briefly, a 2.5 gallon fire extinguisher was loaded with either E6 ExptSamp 1 or E6 ExptSamp 2. The canister was then pressurized with an air compressor to about 120 psi.

The Class A fire testing was conducted at UL (underwriting Laboratories) on a crib fire. The wood crib consists of 18 layers of 8 evenly spaced 38 by 38 by 735 mm trade size (2 by 2 by 29 inches) kiln-dried spruce or fir lumber with alternate layers placed at right angles to one another and the outside edges of the crib stapled or nailed together. Two Class A tests were conducted. In the first test, the wood crib was placed on an angle iron frame, mounted on a weighing platform at a height of 400 mm (16 inches) above the floor. A steel square pan was used to start the fire. The pan was ignited and placed symmetrically under the vertical axis of each wood crib. Commercial grade Heptane was placed in the pan and used for ignition. A 2.5 gallons buckeye fire extinguisher is prepared with 3% solution in water (E6 ExptSamp 3) and pressurized at 100 psi. The crib is ignited with the heptane fuel until burnout of the heptane. The crib is thus well engulfed with the flames. The solution (i.e. E6 ExptSamp 3) was then applied with the fire extinguisher. The result was that the fire was controlled in about 11 seconds with no reignition.

The second test was performed in a closed container to recreate a flashover. The fire was started in the back of the container, and was allowed to grow, heating up the inside of the container and releasing hot gases. The hot gases collect near the top of the container until the energy starts to transfer to plywood sheets inside the container. The inside of the container was engulfed in flames in a matter of minutes. A 10% E6 Concentrate solution (E6 ExptSamp 4) prepared using tap water was placed in a 2.5 gallons buckeye fire extinguisher and pressurized at 120 psi. A smooth bored nozzle was used. In this configuration, the fire was extinguished in 6 seconds and no reignition occurred.

For Class B fires, a UL (Underwriters Laboratories, Inc.) Class B fire test was performed (similar to the testing described above). The results were noted. Both E6 ExptSamp 1 or E6 ExptSamp 2 extinguished Class B fires in the UL test. The E6 ExptSamp 1 extinguished the fire within 1 minute 13 seconds. E6 ExptSamp 2 extinguished the fire within 5 minutes. The test was conducted in a 50 square feet draft free room, using a steel pan, square in shape, and 305 mm in depth. The fuel test is commercial grade heptane, which reproduces a deep seated fire. The wetting agent was prepared at 6% solution. The fuel in the pan is ignited and allowed to free burn for about 60 s before attacking the fire. The flow rate was 10 gallons per minutes set at 5 minutes maximum delivery time, with the nozzle fixed in position at an angle above the horizontal in order to direct the discharge across the pan on to the back board. The fire was totally extinguished in about 75 seconds.

The same test was done at 0.25% dilution and the fire was extinguished in 5 minutes.

Figure 3A:
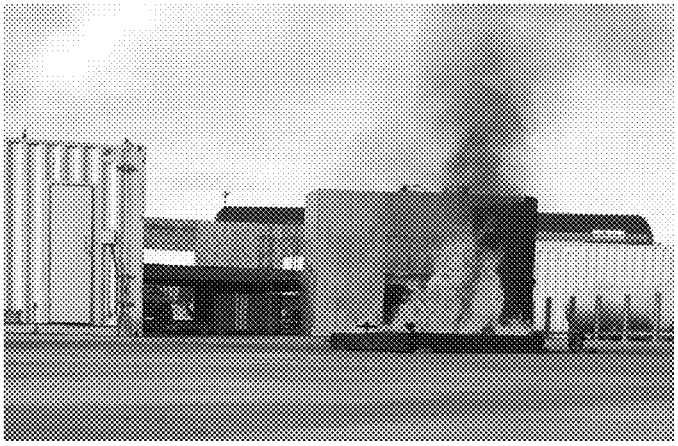
FIGS. 3A-C show the stages and result of application of an embodiment of an extinguishing composition on a diesel/fuel fire.
Figure 3B:
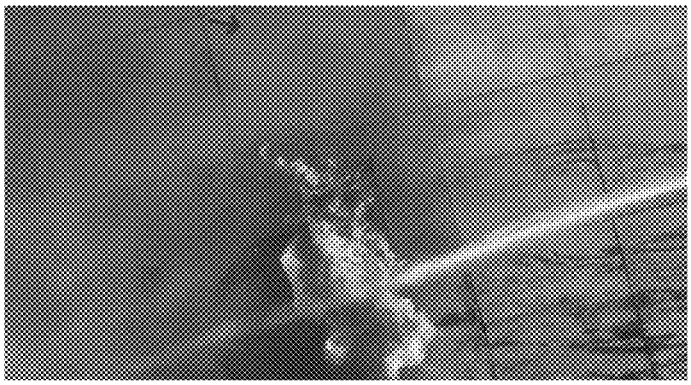
Figure 3C:
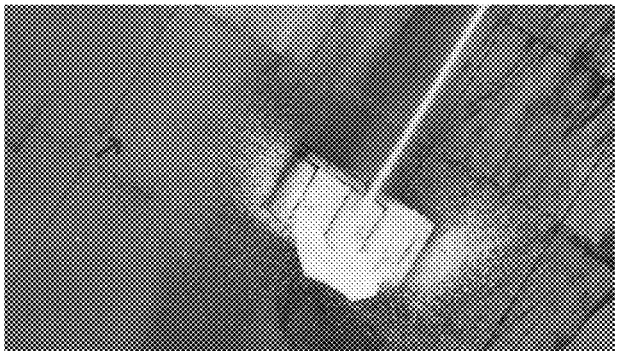

Another test was performed on diesel/fuel, floating on water in a 40 square feet metal pan, to reproduce again a deep seated fire. The flow rate was 95 gallons per minutes, set at 6% dilution for the wetting agent (E6 ExptSamp 1). The fire was extinguished in 5 seconds, with no reignition no matter how many attempts to force reignition, thus confirming total encapsulation. The results are shown in FIGS. 3A-C.

For Class C fires, an electrical fire was started and used to test each formulation separately. Briefly, the fire was started using a 400 amp breaker and a 200 feet length of balled 6 gauge wire. The wire was shorted, thereby igniting it. At that time, a fire extinguishing composition was sprayed from the extinguisher at the burning material at a 45° angle from about 5 feet away. The E6 ExptSamp 1 successfully extinguished the fire and no charge back was noted on the open circuit fire.

Figure 4A:
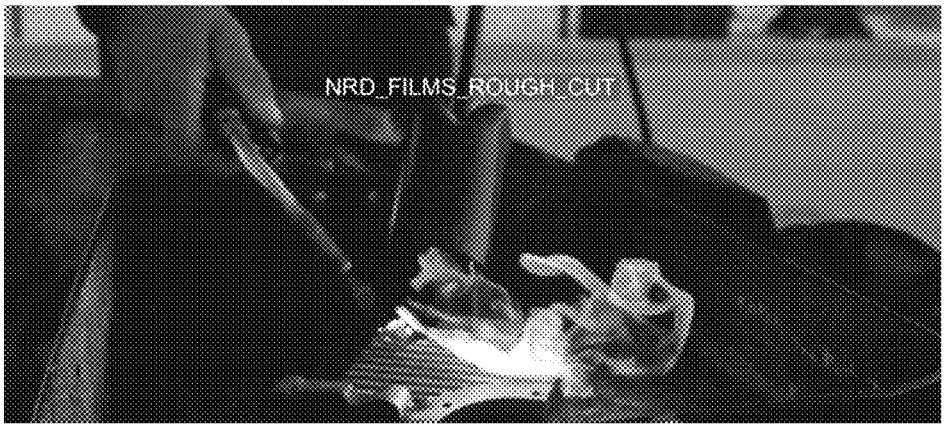
FIGS. 4A-C show the stages and result of application of an embodiment of an extinguishing composition on a magnesium metal fire.
Figure 4B:
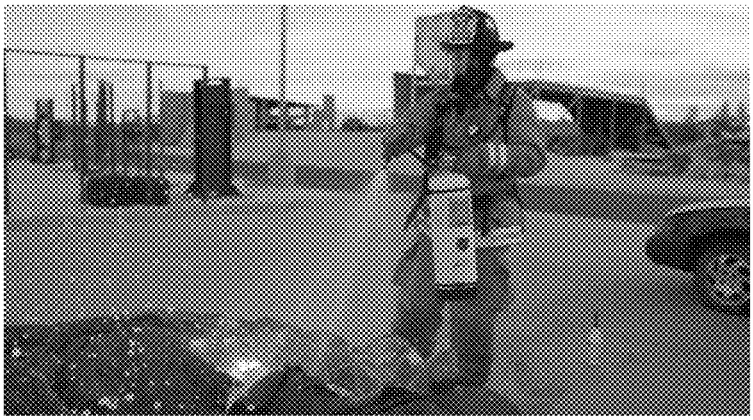
Figure 4C:
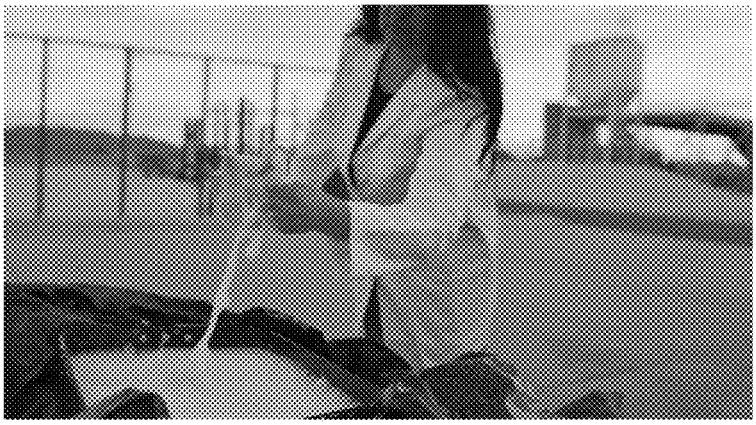

For a Class D fire: a 500 g piece of magnesium was ignited with a torch and allowed to be well inflamed in a few seconds (FIG. 4A). A 2.5 gallons buckeye fire extinguisher was prepared with E6 ExptSamp 4 and tap water, and pressurized at 120 psi. A smooth bore nozzle was used. The solution was then applied to the magnesium fire, and it extinguished it in less than 6 seconds (FIG. 4B). The piece of magnesium was then immediately picked up with bare hands (FIG. 4C).

For Class K fire: a kitchen fire simulation was performed with a turkey fryer by placing a propane tabletop stove on a metal table inside a semi-enclosed room. The turkey fryer was filled with vegetable oil and heated up for 30 minutes until it reached ignition point. The oil ignited on fire and left to burn for one minute. A prior art fire suppression system on the ceiling had been previously installed directly on top of the kitchen table. When the suppressing agent was delivered at a 400 psi pressure onto the engulfed cooking oil it caused a total displacement of the oil out of the fryer and engulfing the all kitchen.

Subsequently, 2 buckeye 2.5 gallons fire extinguishers filled with E6 ExptSamp 4 and tap water, pressurized at 120 psi, using a smooth bore nozzle was then applied onto the fire. The engulfed fire was extinguished with no reignition in less than a minute with the second fire extinguisher still about 50% remaining.

In a test that involves most classes of fire, a car fire was recreated by first pouring 10 gallons of diesel fuel inside of a car to saturate the seats. The fire was started and left to burn for a few minutes until it was fully engulfed. The E6 ExptSamp 1 solution was applied from an induction system in a fire truck set at 95 gallons per minute at a 6% dilution. The fire was out in less than 30 seconds. No toxic fumes where visually noticeable, just water vapor dissipating in seconds, demonstrating the level of encapsulation of the solution applied.

The E6 Concentrate formulation was tested in two real-life fire situations. The first one was on a golf course, where big piles of debris had been burning for 2 days, creating a very deep hot coal fire. Two firefighting crews had been working on it for two days and two helicopter loads each of 1000 gallons of water had been dropped on the piles with no effect. Using the E6 ExptSamp 1 solution out of a type 6 truck, a firefighter extinguished the two piles in less than 3 hours using 800 gallons of water and 17 gallons of solution.

The second fire was the Lilac Fire in San Diego, for structure protection on a house during a firestorm. The fire was raging coming from three sides towards the house. E6 ExptSamp 1 and E7 Concentrate (discussed below) solutions were used on the house out of a type 6 truck. The house was 100% saved with absolutely no burn mark anywhere on the house, or on the deck. Five (5) gallons of E6 ExptSamp 1 solution and 3 gallons of E7 Concentrate solution were used, with 100 gallons of water.

In the suppressant configuration (e.g., the dilute formulation), the addition of surfactant helps the medium to reduce surface tension. Polysaccharides can act as a protective colloid and can also provide transport channels for oil and gas. As a result, it is believed that the surface molecules are attracted toward the interior of the composition, lowering the contact angle, which enables liquids and gas to spread over each other and make the phases mutually miscible. In some embodiments, polysaccharides (such as those in aloe vera and xantham) are thought to interface with water and 1,3-propanediol and that the surfactant acts as an absorbent compound. The interface is then a dynamic site of competing forces. Without being bound to a particular mechanism, it is thought that, as adsorbate, the composition undergoes a non-equilibrium multilayer accumulation of like macromolecules, forming a film with low permeability to oxygen and very strong encapsulating properties by entrapping any dissolved or emulsified solutes (gas and liquids) blocking them from the fuel source.

Several formulations were also tested by increasing the percentage (%) of the surfactant. It is noted that increasing the surfactant concentration in the E6 Concentrate, will increase the amount of foam created. However, that foam is very unstable, with large bubbles and dissipates rapidly, comparable to foams made with only water/surfactant complex, allowing quick reignition for example in a class B fire. It is believed that the Acemannan/polysaccharides/surfactant complex at high concentrations of surfactant is very unstable, and the surfactant imposes its foaming behavior.

The E6 Concentrate passed UL stability and separation testing at 0° C. and 50° C. with no separation for 30 days.

Example 7

Several experiments were performed to measure the cooling effect of embodiments of the compositions disclosed herein and the capacity of those embodiments to protect structures. To prepare a fire suppressing formulation, 4 oz of distilled water was measured and 0.04 oz of aloe vera powder (or 0.014 oz BIOALOE® in a separate composition) was sprinkled into the water with slow mixing until total dissolution. Then in a different container, 0.07 oz of xanthan gum was mixed with 1.5 oz. of 1,3 propanediol. The reconstituted aloe solution and the xanthan gum/1,3 propane diol mixture was then combined and mixed. The mixture was slowly mixed for about 10 minutes until thickening. At that time, 0.05 oz of phenoxyethanol was added. The resulting formulation (hereinafter the "E7 Concentrate") was then ready to use as a concentrate or as a diluted solution.

To test the temperature suppression capabilities of the compositions disclosed herein, 2 oz of E7 Concentrate (a gel) was placed on a top surface of a metal table (steel) as a layer. A thermocouple was placed underneath the table and under the location of the E7 Concentrate. The E7 Concentrate was then heated with a MAPP blow torch at 3800° F. During the initial heating, almost no change in temperature was noted. The temperature reached 300° F. after about 15 minutes before deterioration of the gel. The gel was then wiped clean and left no residue.

Using a commercially available fire extinguishing agent ("Commercial Formulation 1") as control study, the same procedures as used for the E7 Concentrate testing were reproduced. After only 3 minutes and 12 seconds of heating, the thermocouple detected a temperature of 1000° F. for Commercial Formulation 1.

It was also noted that the gel (e.g., the undiluted concentrate) had excellent heat absorption and elasticity therefore protects the surface underneath from fire damage. It adheres to any kind of surfaces, with very little to no runoff in vertical configuration. The gel will be sprayed as is with no further dilution.

As demonstrated here, the compositions as disclosed herein can be used on buildings and other object, e.g. textiles, for the suppression of fire and temperature.

Example 8

The fire extinguishing capabilities of multiple formulations with varying concentrations of the individual constituents were tested on Class A and B fires. For the application testing of each formulation, a 10% solution containing each of the formulations was prepared with tap water in a 2.5-gallon, Buckeye fire extinguisher. Prior to fire testing, the below mentioned formulations were prepared (using procedures as disclosed elsewhere herein). Prior to fire testing the miscibility and phase separation of each formulation was tested. A miscibility test was performed by mixing 15.5 mL of concentrate (cooled to about 3° C.) and adding to 500 mL of deionized water (cooled to about 4° C.). In each case, where necessary, sufficient triethanolamine was added to bring the solution to a pH of 7.0. The solution was then mixed using a mechanical stirring apparatus. For each formulation, where the ingredients of the final composition were miscible, an indication of "M" is used. Where separation of any ingredients did not occur in the final composition, an indication of "NPS" is used.

Formulation A:

| Component | 1 Gal (oz) | 1 Gal (g) | 1 Gal (mL) | % |
|---|---|---|---|---|
| BiAloe powder | 0.32 | 8.93 | | 0.25 |
| Xantham | 0.41 | 11.62 | | 0.32 |
| Cocobetaine | 16.44 | 466.07 | | 12.84 |
| Propanediol | 16.44 | 466.07 | 439.68 | 12.84 |
| Phenoxyethanol | 1.23 | 34.87 | 31.70 | 0.96 |
| DI Water | 93.16 | 2641.04 | 2641.04 | 72.78 |
| Total | 128.00 | 3628.59 | 3785.41 | 100 (NPS) |

Formulation B1:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.89 |
| Propanediol | 16.44 | 466.07 | 439.68 | 12.89 |
| Phenoxyethanol | 1.23 | 34.87 | 31.70 | 0.96 |
| DI Water | 93.16 | 2641.04 | 2641.04 | 73.02 |
| Total | 127.59 | 3616.97 | | 100 (M/NPS) |

Formulation B2:

| Component | 1 Gal (oz) | 1 Gal (g) | 1 Gal (mL) | % |
|---|---|---|---|---|
| BiAloe powder | 0.72 | 20.54 | | 0.57 |
| Cocobetaine | 24.66 | 699.10 | | 19.30 |

-continued

Formulation B2:

| Component | 1 Gal (oz) | 1 Gal (g) | 1 Gal (mL) | % |
|---|---|---|---|---|
| Propanediol | 16.44 | 466.07 | 439.68 | 12.86 |
| Phenoxyethanol | 1.23 | 34.87 | 31.70 | 0.96 |
| DI Water | 84.75 | 2402.62 | 2402.62 | 66.31 |
| Total | 127.80 | 3623.19 | | 100 (M/NPS) |

Formulation B3:

| Component | 1 Gal (oz) | 1 Gal (g) | 1 Gal (mL) | % |
|---|---|---|---|---|
| BiAloe powder | 1.35 | 38.40 | | 1.06 |
| Cocobetaine | 32.88 | 932.13 | | 25.73 |
| Propanediol | 32.88 | 932.13 | 879.37 | 25.73 |
| Phenoxyethanol | 1.23 | 34.87 | 31.70 | 0.96 |
| DI Water | 59.46 | 1685.66 | 1685.66 | 46.52 |
| Total | 127.80 | 3623.19 | | 100 (M) |

Formulation B4:

| Component | 1 Gal (oz) | 1 Gal (g) | 1 Gal (mL) | % |
|---|---|---|---|---|
| Cocobetaine | 32.88 | 932.13 | | 25.73 |
| Propanediol | 37.81 | 1071.95 | 1011.27 | 29.59 |
| Phenoxyethanol | 2.01 | 56.98 | 51.80 | 1.57 |
| DI Water | 55.10 | 1562.06 | 1562.06 | 43.11 |
| Total | 127.80 | 3623.12 | | 100 (M/NPS) |

Formulation B5:

| Component | 1 Gal (oz) | 1 Gal (g) | 1 Gal (mL) | % |
|---|---|---|---|---|
| BiAloe powder | 1.28 | 36.29 | | 1.00 |
| Cocobetaine | 24.66 | 699.10 | | 19.30 |
| Propanediol | 31.24 | 885.52 | 835.40 | 24.44 |
| Phenoxyethanol | 0.66 | 18.71 | 17.01 | 0.52 |
| DI Water | 69.96 | 1983.33 | 1983.33 | 54.74 |
| Total | 127.80 | 3622.95 | | 100 (M) |

Formulation B6:

| Component | 1 Gal (oz) | 1 Gal (g) | 1 Gal (mL) | % |
|---|---|---|---|---|
| BiAloe powder | 0.66 | 18.71 | | 0.52 |
| Cocobetaine | 24.66 | 699.10 | | 19.30 |
| Propanediol | 31.24 | 885.52 | 835.40 | 24.44 |
| DI Water | 71.24 | 2019.62 | 2019.62 | 55.75 |
| Total | 127.80 | 3622.95 | | 100 (M/NPS) |

Formulation B7:

| Component | 1 Gal (oz) | 1 Gal (g) | 1 Gal (mL) | % |
|---|---|---|---|---|
| BiAloe powder | 1.36 | 38.56 | | 1.06 |

-continued

Formulation B7:

| Component | 1 Gal (oz) | 1 Gal (g) | 1 Gal (mL) | % |
|---|---|---|---|---|
| Cocobetaine | 29.26 | 829.51 | | 22.90 |
| Propanediol | 37.72 | 1069.34 | 1008.81 | 29.51 |
| DI Water | 59.46 | 1685.66 | 1685.66 | 46.53 |
| Total | 127.80 | 3623.07 | | 100 (M) |

Formulation B8:

| Component | 1 Gal (oz) | 1 Gal (g) | 1 Gal (mL) | % |
|---|---|---|---|---|
| BiAloe Powder | 0.50 | 14.17 | | 0.39 |
| Cocobetaine | 32.88 | 932.13 | | 25.73 |
| Propanediol | 37.81 | 1071.95 | 1011.27 | 29.59 |
| Phenoxyethanol | 1.51 | 42.81 | 38.92 | 1.18 |
| DI Water | 55.10 | 1562.06 | 1562.06 | 43.11 |
| Total | 127.80 | 3623.12 | | 100 (M/NPS) |

Formulation C:

| Component | 1 Gal (oz) | 1 Gal (g) | 1 Gal (mL) | % |
|---|---|---|---|---|
| BiAloe powder | 0.315 | 8.93 | | 0.25 |
| Xantham | 0.140 | 3.97 | | 0.11 |
| Cocobetaine | 16.440 | 466.07 | | 12.87 |
| Propanediol | 16.440 | 466.07 | 439.68 | 12.87 |
| Phenoxyethanol | 1.230 | 34.87 | 31.70 | 0.96 |
| DI Water | 93.160 | 2641.04 | 2641.04 | 72.94 |
| Total | 127.725 | 3620.94 | 3785.41 | 100 |

Formulation D:

| | | | | |
|---|---|---|---|---|
| BiAloe powder | 0.315 | 8.93 | | 0.25 |
| Xantham | 0.105 | 2.98 | | 0.08 |
| Cocobetaine | 16.440 | 466.07 | | 12.87 |
| Propanediol | 16.440 | 466.07 | 439.68 | 12.87 |
| Phenoxyethanol | 1.230 | 34.87 | 31.70 | 0.96 |
| DI Water | 93.160 | 2641.04 | 2641.04 | 72.96 |
| Total | 127.690 | 3619.95 | 3785.41 | 100 |

Formulation E:

| | | | | |
|---|---|---|---|---|
| BiAloe powder | 0.315 | 8.93 | | 0.25 |
| Xantham | 0.070 | 1.98 | | 0.05 |
| Cocobetaine | 16.440 | 466.07 | | 12.88 |
| Propanediol | 16.440 | 466.07 | 439.68 | 12.88 |
| Phenoxyethanol | 1.230 | 34.87 | 31.70 | 0.96 |
| DI Water | 93.160 | 2641.04 | 2641.04 | 72.98 |
| Total | 127.655 | 3618.96 | 3785.41 | 100 |

Formulation F:

| | | | | |
|---|---|---|---|---|
| BiAloe powder | 0.315 | 8.93 | | 0.25 |
| Xantham | 0.035 | 0.99 | | 0.03 |
| Cocobetaine | 16.440 | 466.07 | | 12.88 |
| Propanediol | 16.440 | 466.07 | 439.68 | 12.88 |

-continued

Formulation F:

| | | | | |
|---|---|---|---|---|
| Phenoxyethanol | 1.230 | 34.87 | 31.70 | 0.96 |
| DI Water | 93.160 | 2641.04 | 2641.04 | 73.00 |
| Total | 127.620 | 3617.96 | 3785.41 | 100 |

Formulation G:

| | | | | |
|---|---|---|---|---|
| BiAloe powder | 0.315 | 8.93 | | 0.25 |
| Xantham | 0.014 | 0.40 | | 0.01 |
| Cocobetaine | 16.440 | 466.07 | | 12.88 |
| Propanediol | 16.440 | 466.07 | 439.68 | 12.88 |
| Phenoxyethanol | 1.230 | 34.87 | 31.70 | 0.96 |
| DI Water | 93.160 | 2641.04 | 2641.04 | 73.01 |
| Total | 127.599 | 3617.37 | 3785.41 | 100 |

Formulation H1:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.84 |
| Propanediol | 16.44 | 466.07 | 439.68 | 12.84 |
| Phenoxyethanol | 1.23 | 34.87 | 31.70 | 0.96 |
| Methyl Cellulose | 0.41 | 11.62 | | 0.32 |
| DI Water | 93.16 | 2641.04 | 2641.04 | 72.78 |
| Total | 128.00 | 3628.59 | | 100 |

Formulation H2:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.85 |
| Propanediol | 16.44 | 466.07 | 439.68 | 12.85 |
| Phenoxyethanol | 1.23 | 34.87 | 31.70 | 0.96 |
| Methyl Cellulose | 0.31 | 8.79 | | 0.24 |
| DI Water | 93.16 | 2641.04 | 2641.04 | 72.84 |
| Total | 127.90 | 3625.76 | | 100 |

Formulation H3:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.86 |
| Propanediol | 16.44 | 466.07 | 439.68 | 12.86 |
| Phenoxyethanol | 1.23 | 34.87 | 31.70 | 0.96 |
| Methyl Cellulose | 0.21 | 5.95 | | 0.16 |
| DI Water | 93.16 | 2641.04 | 2641.04 | 72.90 |
| Total | 127.80 | 3622.92 | | 100 |

Formulation H4:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.88 |

-continued

Formulation H4:

| Component | 1 Gal (oz) | 1 Gal (g) | 1 Gal (mL) | % |
|---|---|---|---|---|
| Propanediol | 16.44 | 466.07 | 439.68 | 12.88 |
| Phenoxyethanol | 1.23 | 34.87 | 31.70 | 0.96 |
| Methyl Cellulose | 0.10 | 2.83 | | 0.08 |
| DI Water | 93.16 | 2641.04 | 2641.04 | 72.96 |
| Total | 127.69 | 3619.81 | | 100 (M) |

Formulation H5:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.88 |
| Propanediol | 16.44 | 466.07 | 439.68 | 12.88 |
| Phenoxyethanol | 1.23 | 34.87 | 31.70 | 0.96 |
| Methyl Cellulose | 0.04 | 1.13 | | 0.03 |
| DI Water | 93.16 | 2641.04 | 2641.04 | 73.00 |
| Total | 127.63 | 3618.10 | | 100 (M) |

Formulation I1:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.84 |
| Propanediol | 16.44 | 466.07 | 439.68 | 12.84 |
| Phenoxyethanol | 1.23 | 34.87 | 31.70 | 0.96 |
| Sodium Carboxymethylcellulose | 0.41 | 11.62 | | 0.32 |
| DI Water | 93.16 | 2641.04 | 2641.04 | 72.78 |
| Total | 128.00 | 3628.59 | | 100 |

Formulation I2:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.85 |
| Propanediol | 16.44 | 466.07 | 439.68 | 12.85 |
| Phenoxyethanol | 1.23 | 34.87 | 31.70 | 0.96 |
| Sodium Carboxymethylcellulose | 0.31 | 8.79 | | 0.24 |
| DI Water | 93.16 | 2641.04 | 2641.04 | 72.84 |
| Total | 127.90 | 3625.76 | | 100 |

Formulation I3:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.86 |
| Propanediol | 16.44 | 466.07 | 439.68 | 12.86 |
| Phenoxyethanol | 1.23 | 34.87 | 31.70 | 0.96 |

-continued

Formulation I3:

| Component | 1 Gal (oz) | 1 Gal (g) | 1 Gal (mL) | % |
|---|---|---|---|---|
| Sodium Carboxymethylcellulose | 0.21 | 5.95 | | 0.16 |
| DI Water | 93.16 | 2641.04 | 2641.04 | 72.90 |
| Total | 127.80 | 3622.92 | | 100 (M) |

Formulation I4:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.88 |
| Propanediol | 16.44 | 466.07 | 439.68 | 12.88 |
| Phenoxyethanol | 1.23 | 34.87 | 31.70 | 0.96 |
| Sodium Carboxymethylcellulose | 0.10 | 2.83 | | 0.08 |
| DI Water | 93.16 | 2641.04 | 2641.04 | 72.96 |
| Total | 127.69 | 3619.81 | | 100 (M) |

Formulation I5:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.88 |
| Propanediol | 16.44 | 466.07 | 439.68 | 12.88 |
| Phenoxyethanol | 1.23 | 34.87 | 31.70 | 0.96 |
| Sodium Carboxymethylcellulose | 0.04 | 1.13 | | 0.03 |
| DI Water | 93.16 | 2641.04 | 2641.04 | 73.00 |
| Total | 127.63 | 3618.10 | | 100 (M) |

Formulation I6:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.83 |
| Propanediol | 16.44 | 466.07 | 439.68 | 12.83 |
| Phenoxyethanol | 1.23 | 34.87 | 31.70 | 0.96 |
| Sodium Carboxymethylcellulose | 0.56 | 15.96 | | 0.44 |
| DI Water | 93.16 | 2641.04 | 2641.04 | 72.70 |
| Total | 128.15 | 3632.93 | | 100 (M) |

Formulation I7:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.95 |
| Propanediol | 16.44 | 466.07 | 439.68 | 12.95 |

-continued

Formulation I7:

| Component | 1 Gal (oz) | 1 Gal (g) | 1 Gal (mL) | % |
|---|---|---|---|---|
| Sodium Carboxymethylcellulose | 0.56 | 15.96 | | 0.44 |
| DI Water | 93.16 | 2641.04 | 2641.04 | 73.40 |
| Total | 126.92 | 3598.06 | | 100 (M) |

Formulation J1:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.88 |
| Propanediol | 16.44 | 466.07 | 439.68 | 12.88 |
| Phenoxyethanol | 1.23 | 34.87 | 31.70 | 0.96 |
| Gellan Gum | 0.04 | 1.13 | | 0.03 |
| DI Water | 93.16 | 2641.04 | 2641.04 | 73.00 |
| Total | 127.63 | 3618.10 | | 100 (M) |

Formulation J2:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.88 |
| Propanediol | 16.44 | 466.07 | 439.68 | 12.88 |
| Phenoxyethanol | 1.23 | 34.87 | 31.70 | 0.96 |
| Gellan Gum | 0.10 | 2.83 | | 0.08 |
| DI Water | 93.16 | 2641.04 | 2641.04 | 72.96 |
| Total | 127.69 | 3619.81 | | 100 (M) |

Formulation J3:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.86 |
| Propanediol | 16.44 | 466.07 | 439.68 | 12.86 |
| Phenoxyethanol | 1.23 | 34.87 | 31.70 | 0.96 |
| Gellan Gum | 0.21 | 5.95 | | 0.16 |
| DI Water | 93.16 | 2641.04 | 2641.04 | 72.90 |
| Total | 127.80 | 3622.92 | | 100 |

Formulation J4:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.85 |
| Propanediol | 16.44 | 466.07 | 439.68 | 12.85 |
| Phenoxyethanol | 1.23 | 34.87 | 31.70 | 0.96 |
| Gellan Gum | 0.31 | 8.79 | | 0.24 |
| DI Water | 93.16 | 2641.04 | 2641.04 | 72.84 |
| Total | 127.90 | 3625.76 | | 100 |

Formulation J5:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.84 |
| Propanediol | 16.44 | 466.07 | 439.68 | 12.84 |
| Phenoxyethanol | 1.23 | 34.87 | 31.70 | 0.96 |
| Gellan Gum | 0.41 | 11.62 | | 0.32 |
| DI Water | 93.16 | 2641.04 | 2641.04 | 72.78 |
| Total | 128.00 | 3628.59 | | 100 |

Formulation K1:

| Component | 1 Gal (oz) | 1 Gal (g) | 1 Gal (mL) | % |
|---|---|---|---|---|
| BiAloe powder | 0.32 | 8.93 | | 0.22 |
| Cocobetaine | 16.44 | 466.07 | | 11.40 |
| Propanediol | 32.88 | 932.13 | 879.37 | 22.80 |
| Phenoxyethanol | 1.23 | 34.87 | 31.70 | 0.85 |
| Sodium Carboxymethylcellulose | 0.21 | 5.95 | | 0.15 |
| DI Water | 93.16 | 2641.04 | 2641.04 | 64.59 |
| Total | 144.24 | 4088.99 | | 100 (M) |

Formulation K2:

| Component | 1 Gal (oz) | 1 Gal (g) | 1 Gal (mL) | % |
|---|---|---|---|---|
| BiAloe powder | 0.32 | 8.93 | | 0.26 |
| Cocobetaine | 16.44 | 466.07 | | 13.75 |
| Propanediol | 8.22 | 233.03 | 219.84 | 6.87 |
| Phenoxyethanol | 1.23 | 34.87 | 31.70 | 1.03 |
| Sodium Carboxymethylcellulose | 0.21 | 5.95 | | 0.18 |
| DI Water | 93.16 | 2641.04 | 2641.04 | 77.91 |
| Total | 119.58 | 3389.89 | | 100 (M) |

Formulation K1':

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.86 |
| Propanediol | 32.88 | 932.13 | 879.37 | 25.73 |
| Phenoxyethanol | 1.23 | 34.87 | 31.70 | 0.96 |
| Sodium Carboxymethylcellulose | 0.21 | 5.95 | | 0.16 |
| DI Water | 76.72 | 2174.97 | 2174.97 | 60.03 |
| Total | 127.80 | 3622.92 | | 100 (M) |

Formulation L1:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 32.88 | 932.13 | | 25.71 |
| Propanediol | 16.44 | 466.07 | 439.68 | 12.86 |
| Phenoxyethanol | 1.23 | 34.87 | 31.70 | 0.96 |

-continued

Formulation L1:

| Component | 1 Gal (oz) | 1 Gal (g) | 1 Gal (mL) | % |
|---|---|---|---|---|
| Sodium Carboxymethylcellulose | 0.21 | 5.95 | | 0.16 |
| DI Water | 76.80 | 2177.24 | | 60.06 |
| Total | 127.88 | 3625.19 | | 100 (M) |

Formulation L2:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 8.22 | 233.03 | | 6.43 |
| Propanediol | 16.44 | 466.07 | 439.68 | 12.86 |
| Phenoxyethanol | 1.23 | 34.87 | 31.70 | 0.96 |
| Sodium Carboxymethylcellulose | 0.21 | 5.95 | | 0.16 |
| DI Water | 101.38 | 2874.07 | 2874.07 | 79.33 |
| Total | 127.80 | 3622.92 | | 100 (M) |

Formulation L2':

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 12.36 | 350.43 | | 9.67 |
| Propanediol | 16.44 | 466.07 | 439.68 | 12.86 |
| Phenoxyethanol | 1.23 | 34.87 | 31.70 | 0.96 |
| Sodium Carboxymethylcellulose | 0.21 | 5.95 | | 0.16 |
| DI Water | 97.24 | 2756.71 | 2756.70 | 76.09 |
| Total | 127.80 | 3622.95 | | 100 (M) |

Formulation L3:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 8.22 | 233.03 | | 6.41 |
| Propanediol | 16.44 | 466.07 | 439.68 | 12.83 |
| Phenoxyethanol | 1.23 | 34.87 | 31.70 | 0.96 |
| Sodium Carboxymethylcellulose | 0.56 | 15.96 | | 0.44 |
| DI Water | 101.38 | 2874.07 | 2874.07 | 79.11 |
| Total | 128.15 | 3632.93 | | 100 (NPS) |

Formulation L4:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 8.22 | 233.03 | | 6.48 |
| Propanediol | 16.44 | 466.07 | 439.68 | 12.95 |

-continued

Formulation L4:

| Component | 1 Gal (oz) | 1 Gal (g) | 1 Gal (mL) | % |
|---|---|---|---|---|
| Sodium Carboxymethylcellulose | 0.56 | 15.96 | | 0.44 |
| DI Water | 101.38 | 2874.07 | 2874.07 | 79.88 |
| Total | 126.92 | 3598.06 | | 100 (NPS) |

Formulation L5:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 8.22 | 233.03 | | 6.42 |
| Propanediol | 16.44 | 466.07 | 439.68 | 12.84 |
| Phenoxyethanol | 1.23 | 34.87 | 31.70 | 0.96 |
| Sodium Carboxymethylcellulose | 0.50 | 14.17 | | 0.39 |
| DI Water | 101.38 | 2874.07 | 2874.07 | 79.15 |
| Total | 128.09 | 3631.15 | | 100 |

Formulation L6:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 8.22 | 233.03 | | 6.42 |
| Propanediol | 16.44 | 466.07 | 439.68 | 12.84 |
| Phenoxyethanol | 1.23 | 34.87 | 31.70 | 0.96 |
| Sodium Carboxymethylcellulose | 0.46 | 13.04 | | 0.36 |
| DI Water | 101.38 | 2874.07 | 2874.07 | 79.18 |
| Total | 128.05 | 3630.01 | | 100 |

Formulation L7:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 8.22 | 233.03 | | 6.42 |
| Propanediol | 16.44 | 466.07 | 439.68 | 12.84 |
| Phenoxyethanol | 1.23 | 34.87 | 31.70 | 0.96 |
| Sodium Carboxymethylcellulose | 0.41 | 11.62 | | 0.32 |
| DI Water | 101.38 | 2874.07 | 2874.07 | 79.21 |
| Total | 128.00 | 3628.59 | | 100 |

Formulation M1:

| Component (pH ~9) | 1 Gal (oz) | 1 Gal (g) | 1 Gal (mL) | % |
|---|---|---|---|---|
| BiAloe powder | 0.32 | 8.93 | | 0.25 |
| Cocobetaine | 16.44 | 466.07 | | 12.86 |
| Propanediol | 16.44 | 466.07 | 439.68 | 12.86 |
| Phenoxyethanol | 1.23 | 34.87 | 31.70 | 0.96 |

-continued

Formulation M1:

| Component (pH ~9) | 1 Gal (oz) | 1 Gal (g) | 1 Gal (mL) | % |
|---|---|---|---|---|
| Sodium Carboxymethylcellulose | 0.21 | 5.95 | | 0.16 |
| DI Water | 93.16 | 2641.04 | 2641.04 | 72.90 |
| Total | 127.80 | 3622.92 | | 100 (M) |

Formulation N1:

| Component | 1 Gal (oz) | 1 Gal (g) | 1 Gal (mL) | % |
|---|---|---|---|---|
| BiAloe powder | 0.63 | 17.86 | | 0.49 |
| Cocobetaine | 32.88 | 932.13 | | 25.65 |
| Propanediol | 16.44 | 466.07 | 439.68 | 12.82 |
| Phenoxyethanol | 1.23 | 34.87 | 31.70 | 0.96 |
| Sodium Carboxymethylcellulose | 0.21 | 5.95 | | 0.16 |
| DI Water | 76.80 | 2177.24 | | 59.91 |
| Total | 128.19 | 3634.12 | | 100 (M) |

Formulation N2:

| Component | 1 Gal (oz) | 1 Gal (g) | 1 Gal (mL) | % |
|---|---|---|---|---|
| BiAloe powder | 0.63 | 17.86 | | 0.49 |
| Cocobetaine | 8.22 | 233.03 | | 6.42 |
| Propanediol | 16.44 | 466.07 | 439.68 | 12.83 |
| Phenoxyethanol | 1.23 | 34.87 | 31.70 | 0.96 |
| Sodium Carboxymethylcellulose | 0.21 | 5.95 | | 0.16 |
| DI Water | 101.38 | 3030.07 | 3030.07 | 83.43 |
| Total | 128.11 | 3631.85 | | 100 (M) |

Formulation O1:

| Component | 1 Gal (oz) | 1 Gal (g) | 1 Gal (mL) | % |
|---|---|---|---|---|
| Cocobetaine | 16.44 | 466.07 | | 12.86 |
| Propanediol | 32.88 | 932.13 | 879.37 | 25.73 |
| Sodium Carboxymethylcellulose | 0.21 | 5.95 | | 0.16 |
| DI Water | 78.27 | 2218.92 | 2218.92 | 61.24 |
| Total | 127.80 | 3623.07 | | 100 (M) |

Formulation O2:

| Component | 1 Gal (oz) | 1 Gal (g) | 1 Gal (mL) | % |
|---|---|---|---|---|
| Cocobetaine | 24.66 | 699.10 | | 19.30 |
| Propanediol | 37.81 | 1071.95 | 1011.27 | 29.59 |
| Sodium Carboxymethylcellulose | 0.21 | 5.95 | | 0.16 |
| DI Water | 65.12 | 1846.12 | 1844.99 | 50.95 |
| Total | 127.80 | 3623.12 | | 100 (M) |

Formulation Q1:

| Component | 1 Gal (oz) | 1 Gal (g) | 1 Gal (mL) | % |
|---|---|---|---|---|
| BiAloe powder | 0.32 | 8.93 | | 0.25 |
| Cocobetaine | 8.22 | 233.03 | | 6.43 |
| Propanediol | 28.23 | 800.31 | 755.01 | 22.09 |
| Sodium Carboxymethylcellulose | 0.04 | 1.13 | | 0.03 |
| DI Water | 90.99 | 2579.52 | 2579.52 | 71.20 |
| Total | 127.80 | 3622.92 | | 100 (M) |

Formulation Q2:

| Component | 1 Gal (oz) | 1 Gal (g) | 1 Gal (mL) | % |
|---|---|---|---|---|
| BiAloe powder | 0.32 | 8.93 | | 0.25 |
| Propanediol | 24.46 | 693.43 | 654.18 | 19.14 |
| Sodium Carboxymethylcellulose | 0.41 | 11.62 | | 0.32 |
| DI Water | 102.61 | 2908.94 | 2908.94 | 80.29 |
| Total | 127.80 | 3622.92 | | 100 (M) |

Formulation Q3:

| Component | 1 Gal (oz) | 1 Gal (g) | 1 Gal (mL) | % |
|---|---|---|---|---|
| BiAloe powder | 0.32 | 8.93 | | 0.25 |
| Propanediol | 36.45 | 1033.34 | 974.85 | 28.52 |
| Sodium Carboxymethylcellulose | 0.21 | 5.95 | | 0.16 |
| DI Water | 90.82 | 2574.70 | 2574.70 | 71.07 |
| Total | 127.80 | 3622.92 | | 100 (M) |

Opal

| | g | mL | Wt % |
|---|---|---|---|
| DI Water | 2000 | 2000 | 65.4 |
| Bialoe Powder | 8.93 | | 0.292 |
| Sodium Carboxymethylcellulose (SCMC) | 46.67 | | 1.53 |
| Propanediol | 965.3 | | 31.6 |
| Phenoxyethanol | 34.87 | 31.7 | 1.14 |

For Formulations A and C-G, xanthan gum, was used as a thickener to not only increase the heat capacity of the mixture but also hinder the concentrate from separating over time. Without being bound to any particular theory, it is believed that xanthan gum can cause the formulation to hold together like a gel (see Formulations A and C-G, below). This gel characteristic can improve its performance in certain firefighting conditions, as disclosed elsewhere herein. For instance, the gel can aid in preventing fires by acting to protect the object/structure. As shown above, Formulation B was fully miscible. This miscibility is useful in firefighting applications where a gel is not needed or desired (such as when using the formulation as an additive to water as water is being deployed from a fire hose).

Figure 5A:
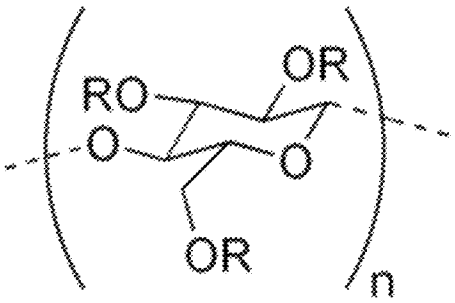
FIGS. 5A-C show various celluloses (methylcellulose in FIG. 5A, carboxymethylcellulose in FIG. 5B, and low acyl gellan gum in FIG. 5C) that can be used as ingredients in the compositions disclosed herein.
Figure 5B:
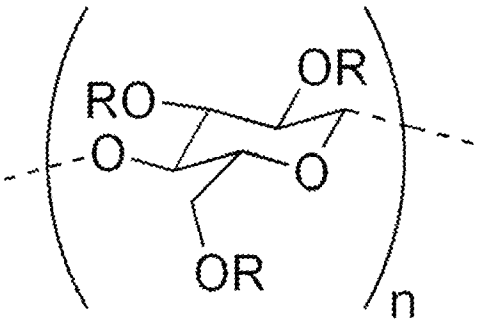
Figure 5C:
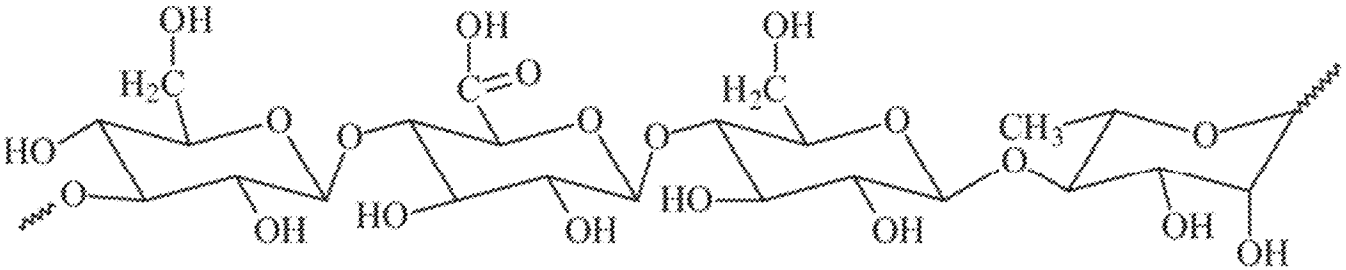

As alternative thickening agents, additional celluloses were selected. In some embodiments, saccharides are used as thickeners. In some embodiments, the saccharides are celluloses. In some embodiments, the celluloses are naturally occurring celluloses. In some embodiments, the celluloses are synthetic. Without being bound to any particular theory, it was proposed that, with a simpler structure off the cellulose backbone, higher miscibility could be achieved along with good thermal stability using one or more of methylcellulose, carboxymethylcellulose (e.g., the sodium salt or potassium salt), and/or gellan gum. Three derivatives selected for testing were methylcellulose (FIG. 5A (where R═H or $CH_3$); Series H; properties: hydrophilic, soluble in cold water (may precipitates at 40° C. or higher, can act as a thickener and/or as an emulsifier), sodium carboxymethylcellulose (FIG. 5B (where R═H or $CH_2CO_2H$); Series I; Properties: hydrophilic, readily soluble in hot and cold water; good compatibility with glycols and other cellulose derivatives, anionic), and low acyl gellan gum (FIG. 5C; Series J; Properties: readily soluble in water, holds particles in suspension well without significantly increasing viscosity, part of a class of hydrogels with good heat resistance). All of these celluloses were chosen because they have favorable properties for the tests being considered.

A series of five formulations for each cellulose derivative (Formulation Series H-J) was made to assess each formulation's ability to extinguish Class B fires of the same fuel source mentioned above, along with their miscibility as a 3% solution at cooler temperatures and their ability to remain as one homogeneous concentrate/solution over a 24-hour period (separation test). After running miscibility on all three series, Sodium Carboxymethylcellulose seemed to disperse into solution more readily than the others (Formulation Series I, "Opal").

Figure 6B:
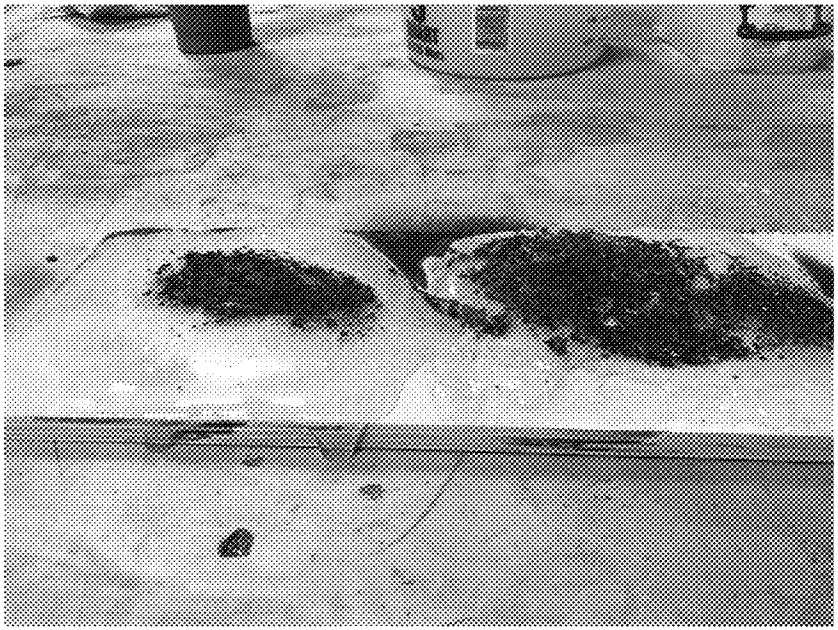
FIGS. 6A-B show embodiments of compositions disclosed herein before (FIG. 6A) and after (FIG. 6B) heat treatment.
Figure 6A:
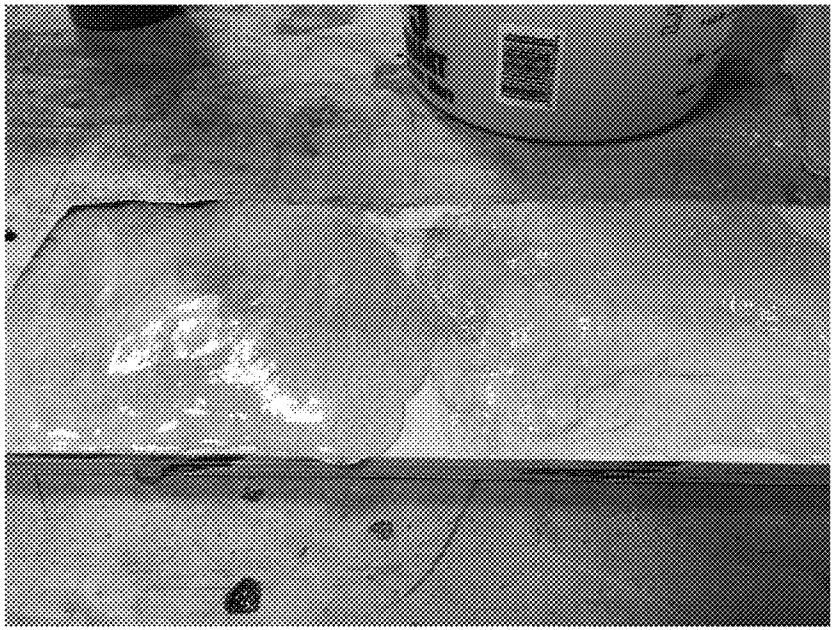

Utilizing Sodium Carboxymethylcellulose as a thickening ingredient for the wetting agent, a gel was made to compare its thermal stability with the previous gel made with Xanthan Gum. Each gel was applied to a piece of wood, side by side, to be then exposed to a flame. A torch, with a flame reaching up to 2500° C., was applied to the center of each gel for one minute. As shown in FIG. 6A (before heating) and FIG. 6B (after heating), the gels, made with Sodium Carboxymethylcellulose (Opal Gel) (on the left) and Xanthan Gum (on the right) substantially protected a wood surface below the gels after heating. Both gels retained much of their structure. It was also noted that both had demonstrated extinguishing properties.

Using sodium carboxymethylcellulose as the thickener, several more formations were prepared, varying other parameters of the formulation to enable fire extinguishing capabilities while assisting in passing separation and stability tests for solutions; see Table 7 for a comparison on their application to Class B fires.

Before testing each solution for its application to the different types of fires, the fire extinguishers were pressurized with an air compressor to about 120 psi. The fire extinguisher used in each test had a smooth bore nozzle. The testing was performed outside at a temperature of about 82° F. with a relative humidity of 20% and calm winds.

For Class A fires, it was concluded that the fire was extinguished with each composition. For Class B fires several formulations were tested with, fires fueled by gasoline. For gasoline fires, a quart of gasoline was poured on top of a 2-inch layer of water in a 20-gallon aluminum wash tub, with a 1.5'×4' sheet metal backdrop attached to catch the spray stream of the wetting agent. Once the gasoline generated a large and hot enough flame, generated by applying a torch to the surface of the fuel, a fire extinguishing composition was sprayed from the extinguisher at the sheet metal from a 45° angle from about 5 feet away. The purpose of this was to reenact the diesel fuel fire to test the wetting agents ability to spread quickly and extinguish a large, contained fire.

TABLE 7

The formulations shown have a trend to put the fire out faster when more surfactant is present; the greater amount of surfactant, the faster the wetting agent spreads throughout the water/gasoline layer to smother the fire with its foam.

| Formulation | Time to Extinguish |
|---|---|
| A | 3 s |
| H-5 | 2.5 s |
| I-3 | 2 s |
| K-1 | 2 s |
| L-1 | 2 s |
| L-2 | 3 s |
| B-4 | 1.5 s |
| B-6 | 2.5 s |
| B-8 | 1.5 s |

Formulation B-8 had good foaming properties and extinguishing capabilities, comprising cocobetaine and 1,3-propanediol in high concentrations. This composition also remained miscible and homogeneous. This composition also had high capacity to extinguish Class B fires quickly and effectively. In this formulation, without being bound to a particular mechanism, 1,3-propanediol is thought to function as the primary thickening agent (with the absence of a cellulose derivative), and the cocobetaine was proposed to be the major foaming agent to smother the fire more effectively. In some embodiments, 1,3-propanediol can act as the thickening agent. Formulations I3 and L3 were also demonstrated to extinguish flames from a magnesium fire rapidly.

Example 9

Several additional formulations were prepared (using procedures as disclosed elsewhere herein). Miscibility testing was performed. For each formulation that follows, a miscibility test was performed at 4° C. (both concentrate and water) with 3% solution, 6% solution and 10% solution each time in 500 ml deionized water. Each solution was then mixed at 60 rpm, with a maximum of 100 rotations allowed to observe the miscibility performances. E6 ExptSamp 1 required higher sheer, mixing at 250 rpm before total dissolution is observed with absolutely no separation at 4° C. Both concentrates and diluted complexes were tested at 0° C. and 50° C. for 30 days with absolutely no separation. In some embodiments, as shown below, sodium gluconate is used. Sodium gluconate is the neutralized form (salt) of gluconic acid. It has excellent chelating properties to bind metal ions especially iron & copper over a wide pH range. It is also a natural alternative to synthetic chelating agents. In some embodiments, various thickeners and hydrocolloids are used. In some embodiments, high molecular weight polysaccharides are used. Some are negatively charged, some are nonionic, some are positively charged. As shown below, pectin, guar gum, agar gum, sodium hyaluronate, xantham gum, hydrolyzed cellulose, hydroxypropyl guar, cationic guar gum were tested. As shown below, carbomers (940 and 980) which are synthetic carboxypolymers cross-linked with ethers were tested. These have a high level of biodegradability (but are not naturally derived). In some embodiments, hydroxypropyltrimonium honey is added to add multivalent cations and ionic strength. Other cationic surfactants could be used, including biodegradable and naturally derived ones. In some embodiments, charged polymer/surfactants are used which can enhance the stability of foam at the bulk and at air/water interface. In some embodiments, these surfactants also enhancing gas permeability and encapsulation. It was found that some polysaccharides have synergetic interactions with acemannan, xantham being one of them. The following formulations have a lower viscosity and will pass the 4 degree UL test, under 40 revolutions at 60 rpm.

Formulation R1

| Ingredient (801.67 g) | Wt % |
|---|---|
| Water: 20 oz (566.99 g) | 70.7 |
| Bialoe powder: 0.068 oz (1.92 g) | 0.24 |
| Xantham gum 0.29 g | 0.036 |
| Propanediol: 4 oz (113.4 g) | 14.1 |
| Cocobetaine 4 oz (113.4 g) | 14.1 |
| Sodium gluconate 0.2 oz (5.67 g) | 0.71 |
| TEA to adjust pH to 6.5 | — |

Formulation R2

| Ingredient (802.7 g) | Wt % |
|---|---|
| Water: 20 oz (566.99 g) | 70.6 |
| Bialoe powder: 0.068 oz (1.92 g) | 0.24 |
| hydrolyzed cellulose: 1.32 g | 0.16 |
| Propanediol: 4 oz (113.4 g) | 14.1 |
| Cocobetaine 4 oz (113.4 g) | 14.1 |
| Sodium gluconate 0.2 oz (5.67 g) | 0.71 |
| TEA to adjust pH to 6.5 | — |

Formulation R3

| Ingredient (802.7 g) | Wt % |
|---|---|
| Water: 20 oz (566.99 g) | 70.6 |
| Bialoe powder: 0.068 oz (1.92 g) | 0.24 |
| hydroxypropyl guar: 1.29 g | 0.16 |
| Propanediol: 4 oz (113.4 g) | 14.1 |
| Cocobetaine 4 oz (113.4 g) | 14.1 |
| Sodium gluconate 0.2 oz (5.67 g) | 0.71 |
| TEA to adjust pH to 6.5 | — |

Formulation R4

| Ingredient (858.08 g) | Wt % |
|---|---|
| Water: 20 oz (566.99 g) | 66.1 |
| Bialoe powder: 0.068 oz (1.92 g) | 0.22 |
| Pectin 0.1 g | 0.012 |
| Propanediol: 4 oz (113.4 g) | 13.2 |
| Cocobetaine: 5 oz (141.7 g) | 16.5 |
| Hydroxypropyltrimonium: 1 oz (28.3 g) | 3.3 |
| Sodium Gluconate: 0.2 oz (5.67 g) | 0.66 |
| TEA to adjust pH to 6.5 | — |

Formulation R5

| Ingredient (858.98 g) | Wt % |
|---|---|
| Water: 20 oz (566.99 g) | 66.0 |
| Bialoe powder: 0.068 oz (1.92 g) | 0.22 |
| guar gum: 1 g | 0.12 |

-continued

Formulation R5

| Ingredient (858.98 g) | Wt % |
|---|---|
| Propanediol: 4 oz (113.4 g) | 13.2 |
| Cocobetaine: 5 oz (141.7 g) | 16.5 |
| Hydroxypropyltrimonium: 1 oz (28.3 g) | 3.2 |
| Sodium Gluconate: 0.2 oz (5.67 g) | 0.66 |
| TEA to adjust pH to 6.5 | — |

Formulation R6

| Ingredient (858.3 g) | Wt % |
|---|---|
| Water: 20 oz (566.99 g) | 66.1 |
| Bialoe powder: 0.068 oz (1.92 g) | 0.22 |
| sodium hyaluronate: 0.3 g | 0.034 |
| Propanediol: 4 oz (113.4 g) | 13.2 |
| Cocobetaine: 5 oz (141.7 g) | 16.5 |
| Hydroxypropyltrimonium: 1 oz (28.3 g) | 3.3 |
| Sodium Gluconate: 0.2 oz (5.67 g) | 0.66 |
| TEA to adjust pH to 6.5 | |

CONCLUSION

In summary, various embodiments and examples of fire extinguishing and/or suppressing compositions, systems and devices related thereto, and their methods of manufacture and use have been disclosed. Although the compositions have been disclosed in the context of various embodiments and examples, it will be understood by those skilled in the art that this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

What is claimed is:

1. A fire extinguishing composition concentrate comprising:

about 0.25% by weight of powdered aloe vera extract;
about 72.8% by weight of deionized water;
about 0.32% by weight of a thickening agent;
about 12.8% by weight of one or more surfactant;
about 12.8% by weight of one or more humectant;
about 0.96% by weight of one or more preservative;
one or more pH adjusting agents in an amount to achieve a pH value in a range from 6.5 to 7.0;
wherein the fire extinguishing composition is halogen-free; and
wherein the fire extinguishing composition is free of sugar alcohols.

2. The fire extinguishing composition of claim 1, wherein the thickening agent is selected from a group consisting of guar gum, carbomer, xanthan gum, gum Arabic, pectin, acacia gum, hydroxyl propyl guar, Sodium Carboxymethylcellulose.

3. The fire extinguishing composition of claim 1, wherein the surfactant is selected from a group consisting of cocobetaine, decyl glycoside, sodium lauroyl lactylate, sodium oleate, potassium laureate, alpha olein sulfonate, cocoglucose, sodium cocoamphoceate, lauryl glycoside, sodium cocoyl glutamate, and sodium lauryl glucose carboxylate.

4. The fire extinguishing composition of claim 1, wherein the humectant is selected from a group consisting of 1,3-propanediol, 1,2-propanediol, and isopropyl isostearate.

5. The fire extinguishing composition of claim 1, wherein the pH adjusting agent is selected from a group consisting of triethylamine, triethanolamine, sodium gluconate, gluconic acid, and citric acid.

6. The fire extinguishing composition of claim 5, wherein the pH adjusting agent is in a range from about 0.01% to about 3% by weight of the composition.

7. The fire extinguishing composition of claim 1, wherein the aloe vera extract is Acemannan.

8. The fire extinguishing composition of claim 1, wherein the preservative is selected from a group consisting of sodium phenoxyethanol, phenoxyethanol, caprylyl glycol, and sorbic acid.

9. The fire extinguishing composition of claim 1, wherein the water is deionized.

* * * * *